US007785374B2

(12) United States Patent
Jones, Jr.

(10) Patent No.: US 7,785,374 B2
(45) Date of Patent: Aug. 31, 2010

(54) METHODS AND COMPOSITIONS FOR IMPARTING STAIN RESISTANCE TO NYLON MATERIALS

(75) Inventor: Dennis J. Jones, Jr., Signal Mountain, TN (US)

(73) Assignee: Columbia Insurance Co., Omaha, NE (US)

( * ) Notice: Subject to any disclaimer, the term of this patent is extended or adjusted under 35 U.S.C. 154(b) by 406 days.

(21) Appl. No.: 11/041,390

(22) Filed: Jan. 24, 2005

(65) Prior Publication Data

US 2006/0162091 A1 Jul. 27, 2006

(51) Int. Cl.
*D06M 15/263* (2006.01)

(52) U.S. Cl. ..... 8/115.6; 8/115.54; 252/8.62; 252/8.84

(58) Field of Classification Search ..... 8/115.6, 8/115.54; 252/8.62, 8.84
See application file for complete search history.

(56) References Cited

U.S. PATENT DOCUMENTS

| | | | | |
|---|---|---|---|---|
| 2,480,775 | A | 8/1949 | Ryan | |
| 3,322,554 | A | 5/1967 | Wyss et al. | 117/17 |
| 3,511,704 | A | 5/1970 | Wyss et al. | 117/245 |
| 3,609,989 | A | 10/1971 | Park | |
| 3,625,754 | A | 12/1971 | Dunn | |
| 3,632,421 | A | 1/1972 | Boyd et al. | |
| 3,632,422 | A | 1/1972 | Maggiolo et al. | |
| 3,639,290 | A | 2/1972 | Fearnley et al. | |
| 3,649,165 | A | 3/1972 | Cotton | |
| 3,652,212 | A | 3/1972 | Machell | |
| 3,655,566 | A | 4/1972 | Robinson et al. | |
| 3,666,680 | A | 5/1972 | Briggs | |
| 3,669,611 | A | 6/1972 | Shimauchi et al. | |
| 3,706,594 | A | 12/1972 | Wasley et al. | |
| 3,799,992 | A | 3/1974 | Pittman et al. | |
| 3,816,167 | A | 6/1974 | Schultz et al. | |
| 3,816,229 | A | 6/1974 | Bierbrauber | |
| 3,857,757 | A | 12/1974 | Benisek | |
| 3,885,911 | A | 5/1975 | Habib | |
| 3,912,681 | A | 10/1975 | Dickson | |
| 3,916,053 | A | 10/1975 | Sherman et al. | |
| 3,920,389 | A | 11/1975 | Eanzel | |
| 3,948,838 | A | 4/1976 | Hinton, Jr. et al. | |
| 3,961,881 | A | 6/1976 | Sumner et al. | |
| 3,993,830 | A | 11/1976 | Dickson et al. | |
| 3,999,940 | A | 12/1976 | Freeman | |
| 4,043,964 | A | 8/1977 | Sherman et al. | |
| 4,052,158 | A | 10/1977 | Weil | |
| 4,071,463 | A | 1/1978 | Steinhauer | |
| 4,076,631 | A | 2/1978 | Caruso et al. | |
| 4,081,383 | A | 3/1978 | Warburton, Jr. et al. | |
| 4,087,394 | A | 5/1978 | Concannon | |
| 4,094,701 | A | 6/1978 | Fekete | 134/2 |
| 4,144,367 | A | 3/1979 | Landucci | |
| 4,203,859 | A | 5/1980 | Kirn et al. | |
| 4,208,173 | A | 6/1980 | Gregorian et al. | |
| 4,264,484 | A | 4/1981 | Patel | |
| 4,293,600 | A | 10/1981 | Fink et al. | |
| 4,295,976 | A | 10/1981 | Dessaint et al. | |
| 4,325,857 | A | 4/1982 | Champaneria | |
| 4,340,749 | A | 7/1982 | Patel | |
| 4,351,736 | A | 9/1982 | Steinberger et al. | |
| 4,355,065 | A | 10/1982 | DeMott | |
| 4,382,798 | A | 5/1983 | Suzuki et al. | |
| 4,388,205 | A | 6/1983 | Stettler et al. | |
| 4,426,476 | A | 1/1984 | Chang | |
| 4,501,591 | A | 2/1985 | Ucci et al. | |
| 4,592,940 | A | 6/1986 | Blyth et al. | |
| 4,619,853 | A * | 10/1986 | Blyth et al. | 428/95 |
| 4,680,212 | A | 7/1987 | Blyth et al. | |
| 4,699,812 | A | 10/1987 | Munk et al. | |
| 4,780,099 | A | 10/1988 | Greschler et al. | |
| 4,781,844 | A | 11/1988 | Kortmann et al. | |
| 4,800,118 | A | 1/1989 | Reed et al. | |
| 4,822,373 | A | 4/1989 | Olson et al. | |
| 4,833,009 | A | 5/1989 | Marshall | |
| 4,842,646 | A | 6/1989 | Gamblin | |
| 4,875,901 | A | 10/1989 | Payet et al. | |
| 4,883,839 | A | 11/1989 | Fitzgerald et al. | |
| 4,908,149 | A | 3/1990 | Moore et al. | |
| 4,925,707 | A | 5/1990 | Vinod | |
| 4,937,123 | A * | 6/1990 | Chang et al. | 428/96 |
| 4,948,650 | A | 8/1990 | Fitzgerald et al. | |
| 5,001,004 | A | 3/1991 | Fitzgerald et al. | |
| 5,009,667 | A | 4/1991 | Beck et al. | |
| 5,032,136 | A | 7/1991 | Fitzgerald et al. | |
| 5,057,121 | A | 10/1991 | Fitzgerald et al. | |
| 5,073,442 | A | 12/1991 | Knowlton et al. | |

(Continued)

FOREIGN PATENT DOCUMENTS

| | | |
|---|---|---|
| EP | 0 261 637 | 3/1988 |

(Continued)

OTHER PUBLICATIONS

Baxley and Miller, "Effects of suessen heat setting variables on streaks in finished nylon carpet" Textile Res. J. 61(12):697-704 (1991).

(Continued)

*Primary Examiner*—Lorna M Douyon
*Assistant Examiner*—Amina Khan
(74) *Attorney, Agent, or Firm*—Ballard Spahr LLP

(57) ABSTRACT

The present invention provides nylon 6 and nylon 6,6 materials having resistance to staining by a wide variety of staining agents including, but not limited to, coffee, red wine, mustard, tumeric, Betadine®, bleach, benzoyl peroxide, as well as other types of common staining agents. The invention also provides fibers, yarns and carpet products prepared from such stain resistant nylon materials. Yet further, the present invention provides methods of imparting stain resistance to nylon materials. Methods of providing such treated fibers are set forth.

23 Claims, 17 Drawing Sheets
(9 of 17 Drawing Sheet(s) Filed in Color)

U.S. PATENT DOCUMENTS 5,074,883 A 12/1991 Wang
5,108,684 A 4/1992 Anton et al.
5,110,317 A 5/1992 Hangey et al.
5,126,138 A 6/1992 McGee et al.
5,131,909 A 7/1992 Hangey
5,131,914 A 7/1992 Kelley
5,137,759 A 8/1992 Vinod
5,145,487 A 9/1992 Hangey et al.
5,152,803 A 10/1992 Hangey et al.
5,155,178 A 10/1992 Windley
5,164,261 A 11/1992 Windley
5,223,340 A 6/1993 Moss, III et al.
5,229,483 A 7/1993 Fitzgerald
5,230,708 A 7/1993 Hangey et al.
5,232,743 A 8/1993 Calcaterra et al.
5,234,466 A 8/1993 Sargent et al.
5,242,733 A 9/1993 Windley
5,252,232 A 10/1993 Vinod
5,252,375 A 10/1993 Turbak et al.
5,316,850 A 5/1994 Sargent et al.
5,328,766 A 7/1994 Smith
5,342,417 A 8/1994 Pacifici et al.
5,348,785 A 9/1994 Vinod
5,348,786 A 9/1994 Calcaterra et al.
5,356,689 A 10/1994 Pechhold
5,358,769 A 10/1994 Pechhold
5,383,972 A 1/1995 Waltz
5,401,554 A 3/1995 Armen
5,403,362 A 4/1995 Gurley
5,417,724 A 5/1995 Pacifici et al.
5,436,049 A 7/1995 Hu
5,447,755 A 9/1995 Pechhold et al.
5,451,259 A 9/1995 Krogh
5,457,259 A 10/1995 Elgarhy et al.
5,459,188 A 10/1995 Sargent et al.
5,460,887 A 10/1995 Pechhold
5,460,891 A 10/1995 Buck et al.
5,464,911 A 11/1995 Williiams et al.
5,468,554 A 11/1995 Windley
5,516,337 A 5/1996 Nguyen
5,520,962 A 5/1996 Jones, Jr.
5,522,580 A 6/1996 Varner, Jr. et al.
5,545,833 A 8/1996 Stoddard
5,549,963 A 8/1996 Elgarhy et al.
5,558,916 A 9/1996 Helm et al.
5,560,992 A 10/1996 Sargent et al.
5,571,444 A 11/1996 Fisher et al.
5,571,551 A 11/1996 Fusi et al.
5,574,106 A 11/1996 Allen
5,616,151 A 4/1997 Sargent et al.
5,618,604 A 4/1997 Dohn
5,639,500 A 6/1997 Fusi et al.
5,654,068 A 8/1997 Pechhold
5,662,716 A 9/1997 Sun
5,669,937 A 9/1997 McBride et al.
5,670,246 A 9/1997 Pechhold et al.
5,672,674 A 9/1997 Walz et al.
5,681,604 A * 10/1997 Li et al. ..... 426/540
5,708,087 A 1/1998 Buck et al.
5,725,889 A 3/1998 Buck
5,736,468 A 4/1998 Elgarhy
5,738,688 A * 4/1998 De Lathauwer ..... 8/115.56
5,750,445 A 5/1998 Pechhold et al.
5,770,656 A 6/1998 Pechhold
5,821,177 A 10/1998 Elgarhy
5,824,372 A 10/1998 Pechhold
5,830,572 A 11/1998 Anton et al.
5,851,595 A 12/1998 Jones, Jr.
5,853,814 A 12/1998 Murphy
5,906,877 A 5/1999 Popper et al.
5,908,663 A * 6/1999 Wang et al. ..... 427/322
5,939,166 A 8/1999 Cheng et al.
5,948,480 A 9/1999 Murphy
5,965,232 A 10/1999 Vinod
6,013,732 A 1/2000 Yamana et al.
6,023,823 A 2/2000 Yeh et al.
6,024,770 A 2/2000 De Lathauwer
6,071,869 A 6/2000 Materniak et al.
6,098,392 A 8/2000 Tung
6,117,550 A 9/2000 Studholme
6,197,378 B1 3/2001 Clark et al.
6,207,594 B1 3/2001 Elgarhy
6,238,792 B1 5/2001 Pechhold et al.
6,300,299 B1 10/2001 Murphy et al.
6,309,471 B1 10/2001 Smith et al.
6,387,448 B1 * 5/2002 Collier et al. ..... 427/385.5
6,395,655 B1 5/2002 Elgarhy
6,420,044 B1 7/2002 Studholme
6,443,998 B1 9/2002 Jones
6,458,443 B2 10/2002 Collier et al.
6,488,893 B1 12/2002 Elgarhy et al.
6,524,492 B2 2/2003 Williams et al.
6,613,862 B2 9/2003 Clark et al.
6,616,856 B1 9/2003 Pacifici et al.
6,635,346 B2 10/2003 Studholme
6,635,347 B1 10/2003 Yoshida
6,719,810 B1 4/2004 Kelly et al.
6,793,684 B1 9/2004 Jarvis et al. ..... 8/116.1
6,811,574 B2 11/2004 Baumann et al.
6,814,758 B1 11/2004 Pacifici et al.
6,814,881 B2 11/2004 Elgarhy
7,157,121 B2 * 1/2007 Jones, Jr. ..... 427/412
7,276,085 B2 * 10/2007 Jones, Jr. ..... 8/115.56
7,488,351 B2 * 2/2009 Jones, Jr. ..... 8/115.56
2001/0005530 A1 6/2001 Clark et al.
2001/0008919 A1 * 7/2001 Collier et al. ..... 525/176
2001/0027581 A1 10/2001 Sun
2001/0046583 A1 11/2001 Wilson et al.
2001/0051267 A1 12/2001 Maugans et al.
2001/0052154 A1 12/2001 Kelly et al.
2002/0005250 A1 1/2002 Jerdee et al.
2002/0019490 A1 2/2002 Maugans et al.
2002/0137415 A1 9/2002 Elgarhy
2002/0144353 A1 10/2002 Baumann et al.
2002/0148049 A1 10/2002 Baumann et al.
2002/0151644 A1 10/2002 Williams et al.
2002/0155288 A1 10/2002 Studholme
2002/0189023 A1 12/2002 Yamaguchi et al.
2003/0015282 A1 1/2003 Reisdorf et al.
2003/0026938 A1 2/2003 Collier et al.
2003/0051294 A1 3/2003 Yamaguchi et al.
2003/0116744 A1 6/2003 Kimbrell
2003/0157256 A1 8/2003 Yamaguchi et al.
2003/0157296 A1 8/2003 Fitzgerald et al.
2003/0203153 A1 * 10/2003 Jones, Jr. ..... 428/95
2004/0046279 A1 3/2004 Studholme
2004/0060121 A1 4/2004 Williams et al.
2004/0074011 A1 4/2004 Jones, Jr.
2004/0123398 A1 7/2004 Baumann et al.
2004/0123399 A1 7/2004 Baumann et al.
2004/0138083 A1 7/2004 Kimbrell, Jr. et al.
2004/0144406 A1 7/2004 Garabedian et al.
2004/0152840 A1 8/2004 Studholme
2004/0202816 A1 10/2004 Jones, Jr.
2004/0229009 A1 11/2004 Elgarhy
2005/0015886 A1 * 1/2005 Jones, Jr. ..... 8/115.6

FOREIGN PATENT DOCUMENTS

GB 1 254 541 11/1971
JP 36 22937 11/1961
JP 47 32185 11/1972
JP 49 19191 2/1974
JP 58 154 772 9/1983

| | | |
|---|---|---|
| JP | 60 110977 | 6/1985 |
| JP | 62 238 887 | 3/1986 |
| JP | 61 174 485 | 8/1986 |
| JP | 61 252 383 | 11/1986 |
| JP | 62 263389 | 11/1987 |
| JP | 64 68575 | 3/1989 |
| JP | 35 00189 | 1/1991 |
| JP | 35 00307 | 1/1991 |
| JP | 5 214627 | 8/1993 |
| JP | 214626 | 8/1993 |
| JP | 6 2286 | 1/1994 |
| WO | WO 9509266 | 4/1995 |
| WO | WO 9521955 | 8/1995 |
| WO | WO/00/29664 | 5/2000 |
| WO | WO 02072942 | 9/2002 |

OTHER PUBLICATIONS

Cook et al. "The effect of some aromatic hydroxyl compounds on the absorption of anionic dye by nylon 6," Textile Res. J. 47(244):244-249 (1977).
DuPont Filaments, Conditioning Nylon Filaments, Technical Information.
Gupta et al. "Dye-uptake behaviour of nylon-6 filaments and its structural dependence" JSDC 116:385-390 (2000).
Harris and Hangey, "Stain Resist chemistry for nylon-6 carpet" SAC Synthesis 21(11):25-30 (1989).
http://aml.arizona.edu/classes/mse222/1998/nylon66/mse22.htm.
http://www.apparelsearch.com/education_reserach_nonwoven_nylon_fiber.htm.
Ogasawara et al, "Studies on the mechanism of dye fixation. Part 10. Effect of after treatment with tannic acid on the fixation of disperse, acid, direct and basic dyes." Textiles 7:73 (1982).
Rodger and Lee, "Structural Properties of Nylon 66 Carpet yarns observed with near infrafed analysis" Textile Res. J. 61(9):531-536 (1991).
Rollins et al. "Thermal mechanical analysis (TMA) and yarn shrinkage as methods to determine heat set temperature in nylon" American Dyestuff Reporter 36-41(1998).
Sichina, "Detection of Heat set temperatures of nylon 66 carpet yarns by DSC" Perkin Elmer instruments; www. Perkingelmer.com (2000).
Tincher et al. "Characterization of heat set nylon carpet yarn" Applications of NIRS 18(2):25-30 (1996).
Trotman, "Dyeing and Chemical technology of textiles fibers" 6th edition:474-478,480 (1984).
PCT Search Report from PCT/US2006/002432.
Office Action dated Dec. 17, 2004 from U.S. Appl. No. 10/627,945.
Office Action dated Jul. 27, 2005 from U.S. Appl. No. 10/627,945.
Office Action dated Jan. 11, 2006 from U.S. Appl. No. 10/627,945.
Office Action dated Jun. 13, 2006 from U.S. Appl. No. 10/627,945.
Office Action dated Oct. 7, 2005 from U.S. Appl. No. 11/007,840.
Office Action dated May 4, 2006 from U.S. Appl. No. 11/007,840.
Non-Final Rejection mailed on Oct. 4, 2006, from U.S. Appl. No. 10/627,945.
Feb. 22, 2007 Response to Office Action dated Oct. 4, 2006, from U.S. Appl. No. 10/627,945.
Final Rejection mailed on May 17, 2007, from U.S. Appl. No. 10/627,945.
Notice of Panel Decision from Pre-Appeal Brief Review mailed on Oct. 2, 2007, from U.S. Appl. No. 10/627,945.
Jan. 2, 2008 Appeal Brief from U.S. Appl. No. 10/627,945.
Feb. 14, 2008 Response to Notification of Non-Compliant Appeal Brief, from U.S. Appl. No. 10/627,945.
Aug. 20, 2007 Pre-Brief Conference Request, from U.S. Appl. No. 10/627,945.
Office Action mailed on Jan. 12, 2007, from U.S. Appl. No. 11/007,840.
Feb. 22, 2007 Response to Office Action dated Jan. 12, 2007, from U.S. Appl. No. 11/007,840.
Notice of Allowance dated May 21, 2007, from U.S. Appl. No. 11/007,840.
U.S. Appl. No. 11/842,769, Sep. 19, 2008, Non-final Office Action.
U.S. Appl. No. 11/842,769, Sep. 30, 2008, Examiner Interview Summary Record.
U.S. Appl. No. 11/842,769, Sep. 30, 2008, Notice of Allowance.

* cited by examiner

Comparison of Inventive Treatments vs. U.S. Patent No. 6,814,758 (comp = comparative example)

Figure 2: Betadine Stain Ratings
Comparison of Stainblocker Type and Spray Treatment
Scholar Type 6 Greige Carpet Samples
(No Exhaustible Polymer Treatment)

Figure 3: Betadine Stain Ratings
Comparison of Stainblocker Type and Spray Treatment
Academy Type 6, 6
(No Exhaustible Polymer Treatment)

Figure 4: Betadine Stain Ratings
Comparison of Stainblocker Type and Spray Treatment
Academy T 66 Nylon Griege Sample
With Exhaustible Polymer Treatment-52 DM 12 % OWF Figure 5: Betadine Stain Ratings
Comparison of Stainblocker Type and Spray Treatment
Academy T 66 Nylon Griege Sample
With Exhaustible Polymer Treatment-ECO 12 % OWF Figure 6: Betadine Stain Ratings
Comparison of Stainblocker Type and Spray Treatment
Scholar T 6 Nylon Griege Sample
With Exhaustible Polymer Treatment-52 DM 12 % OWF Figure 7: Betadine Stain Ratings
Comparison of Stainblocker Type and Spray Treatment
Scholar T 6 Nylon Griege Sample
With Exhaustible Polymer Treatment-ECO 12 % OWF

1339 Type 6 Nylon Cut Pile

1339 Type 6 Nylon Cut Pile

FIGURE 14-SUMMARY OF DATA IN TABLES 5A-5D

| Condition | Comparative U.S.Pat.6814758 Betadine Decmc Stainblocker Only | | Invention 2 step mode Betadine Decmc Stainblocker and Topical | | Invention 3 step mode Betadine Decmc Stainblocker 52DM polymer and Topical | | Invention 3 step mode Betadine Decmc Stainblocker ECO polymer and Topical | | Comparative U.S.Pat.6814758 Xenon 40 hr Decmc Stainblocker Only | | Invention 3 step mode Xenon 40 hr Decmc Stainblocker 52DM polymer and Topical | |
|---|---|---|---|---|---|---|---|---|---|---|---|---|
| | **Cont B1** | **Exh B1** | **Cont B1** | **Exh B1** | **Cont B1** | **Exh B1** | **Cont B1** | **Exh B1** | **Cont B1** | **Exh B1** | **Cont B1** | **Exh B1** |
| **N201A - 16% owf (SAC)** | | | | | | | | | | | | |
| Academy T66 Cationic loop pile | 5.05 | **3.41** | **2.95** | **1.59** | **4.43** | **2.85** | **3.08** | **1.18** | 1.74 | 1.74 | 0.9 | 0.91 |
| Scholar T6 Acid loop pile | 16.5 | **3.55** | 6.09 | **2.91** | **2.68** | **3.44** | 13.26 | 9.35 | 3.27 | 3.25 | 0.72 | 1.07 |
| 2099 T66 Acid cut pile | 39.11 | 54.51 | **22.5** | 47.3 | **24.15** | **29.02** | 37.34 | 64.09 | 9.82 | 5.5 | 4.83 | 3.25 |
| 1339 T6 Acid cut pile | 61.73 | **25.39** | 48.67 | **19.72** | **26.46** | **24** | 46.41 | 41.38 | 8.06 | 13.62 | 10.39 | 9.82 |
| **LFS30F-16% plus CLM - 1% owf** | | | | | | | | | | | | |
| Academy T66 Cationic loop pile | 16.87 | 7.76 | 6.02 | **3.65** | 7.07 | 5.54 | 7.58 | 10.69 | 0.6 | 1.89 | 0.68 | 1.45 |
| Scholar T6 Acid loop pile | 10.59 | **3.72** | **4.96** | **3.34** | **2.02** | **3.26** | 12.86 | **4.95** | 2.43 | 2.64 | 2.02 | 1.62 |
| 2099 T66 Acid cut pile | 55.3 | 61.48 | 39.56 | 58.82 | 38.44 | 41.3 | 52.64 | 61.4 | 2.36 | 1.45 | 1.1 | 1.44 |
| 1339 T6 Acid cut pile | 50.57 | 66.37 | **33.45** | 49.72 | **19.75** | 46.35 | 62.59 | 59.68 | 4.58 | 2.96 | 4.59 | 4.7 |
| **FX661 - 16% owf** | | | | | | | | | | | | |
| Academy T66 Cationic loop pile | 14.51 | 18.52 | **4.99** | 13.92 | 5.81 | 6.79 | 6.08 | 8.02 | 0.18 | 0.56 | 0.35 | 0.61 |
| Scholar T6 Acid loop pile | 10.48 | **4.07** | **3.31** | **2.21** | **3.41** | **3.39** | 6.02 | **4.97** | 1.56 | 0.73 | 1.63 | 2.44 |
| 2099 T66 Acid cut pile | 62.6 | 64.4 | 53.77 | 61.56 | 48.71 | 44.47 | 64.25 | 64.52 | 4.87 | 4.57 | 3.74 | 3.94 |
| 1339 T6 Acid cut pile | 66.31 | 73.15 | **33.33** | 52.11 | 44.7 | 49.8 | 59.47 | 67.6 | 2.28 | 1.98 | 3.75 | 2.68 |
| **Myalon RM - 16% owf ( SAC)** | | | | | | | | | | | | |
| Academy T66 Cationic loop pile | 6.88 | **4.58** | **3.08** | **2.12** | **3.74** | 5.33 | **2.39** | **3.22** | 0.65 | 0.54 | 0.81 | 0.56 |
| Scholar T6 Acid loop pile | 9.74 | **2.61** | **3.76** | **1.38** | **4.68** | **2.42** | 7.75 | **4.77** | 2.78 | 1.8 | 1.42 | 1.59 |
| 2099 T66 Acid cut pile | 48 | 60.04 | 45.34 | 53.77 | **31.09** | 36.22 | 63.49 | 66.63 | 3.29 | 1.9 | 1.26 | 1.23 |
| 1339 T6 Acid cut pile | 55.22 | 45.91 | 50.09 | 44.62 | **20.43** | **15.03** | 38.2 | 33.78 | 8.11 | 7.75 | 10.15 | 8.97 |
| **Untreated** | | | | | | | | | | | | |
| Academy T66 Cationic loop pile | 19.01 | | | | | | | | 0.37 | | | |
| Scholar T6 Acid loop pile | 20.91 | | | | | | | | 0.69 | | | |
| 2099 T66 Acid cut pile | 66.89 | | | | | | | | 3.71 | | | |
| 1339 T6 Acid cut pile | 75.6 | | | | | | | | 1.58 | | | |

> Betadine DEcmc values in bold represent a 75% or greater reduction in staining as measured by DEcmc, for the loop pile products.
> Betadine Decmc values in bold represent a 50% or greater reduction in staining as measured by DEcmc , for the cut pile products .
> With the SAC compounds, the two or three step mode of the invention outperforms the single step application in all cases.
> With the inventive samples, significant improvement in Betadine staining is seen with stainblocker systems other than SAC's.
> With the inventive samples, in most cases, significant improvement in xenon lightfastness is seen, as compared with results from the single step mode .
> In most samples, the exhaust application of the stainblocker provides improved stain resistance and better lightfastness as compared to the continuous application mode for the stainblocker .
> Topical treatment used is Daikin TG 3361 - 0.50% owf wet material on dry fiber.

METHODS AND COMPOSITIONS FOR IMPARTING STAIN RESISTANCE TO NYLON MATERIALS

FIELD OF THE INVENTION

The invention provides nylon materials, for example, nylon 6 and nylon 6,6 fibers, yarns and carpets, having resistance to staining by a wide variety of staining agents including, but not limited to, neutral colorants such as, Betadine®, i.e., a 10% povidone-iodine solution, and mustard. The present invention also provides nylon materials with resistance to staining by other types of staining agents, such as, for example, coffee, Kool-Aid® and red wine. Methods of imparting such stain resistance are also provided.

BACKGROUND OF THE INVENTION

Yarns prepared from nylon fibers, such as nylon 6 and nylon 6,6, are commonly used to prepare tufted carpets. Because of cationic charged groups on nylon fibers, such carpets are subject to staining by acid-functional agents (or "acid dyes"), such as those contained in flavored beverages (i.e., Kool-Aid®) or coffee. Such stains are often permanent and over the years much effort has been put into methods of preventing staining by these common staining agents.

To reduce the propensity of nylon fibers to stain with acid dyes, various stainblocker treatments have been used. These stainblocker treatments normally function by blocking the negative charges on the fibers so as to prevent acid dyes from attaching to the fibers. Generally, the stainblocker treatments will leave a net negative charge on the nylon fiber surface to further repel staining by acid dyes. Sulfonated aromatic aldehyde condensation polymers ("SAC") and methacrylate type anionic polymers are commonly applied to acid dyeable nylon fibers as stainblockers. Typical stainblockers are disclosed, for example, in U.S. Pat. Nos. 4,501,591, 4,592,940, 4,680,212, 4,780,099, 4,865,885, 4,822,373, 4,875,901, and 4,937,123. The disclosures of each of these patents are incorporated herein in their entireties by this reference.

Acid dyes will not normally stain cationic dyeable fibers. Cationic dyeable nylon fibers have free negative charges and will exhibit resistance to anionic colorant stains. Because of this inherent stain resistance, cationic dyeable fibers have experienced an increased usage in recent years, particularly in commercial carpets used for schools, offices, healthcare facilities and in the food service industry.

In both acid dyeable nylon fibers treated with a stainblocker and in cationic dyeable fibers, acid dyestuffs spilled on the fibers can be removed by rinsing or extracting with water. However, disperse (or uncharged) dyestuffs will still stain nylon fibers treated with stainblockers, as well as cationic dyeable nylon fibers. Disperse dyes that will commonly come into contact with nylon fibers in use are iodine (such as in a Betadine, which is a 10% povidone iodine solution made by Purdue Pharma, LP) and turmeric (such as in mustard products). The colorants contained in Betadine and mustard are neutrally charged and are accordingly unaffected by a charge/charge repulsion mechanism. Due to their uncharged nature, these colorants can diffuse into the nylon polymer structure to cause a stain. Betadine and mustard stains are often very difficult (and sometimes almost impossible) to clean because the stains are often very tenacious after diffusion of the staining agent into the nylon fiber.

Since traditional stainblocker chemicals are ineffective in preventing staining by disperse dyes, methods of addressing staining by mustard and Betadine have historically involved attempts to remove the stains after the fiber is stained. Quite often, these recommended methods and cleaning agents for removing mustard and Betadine stains can damage the color of dyed nylon fibers, therefore causing dye fading or other discoloration. Also, these treatments can remove the stainblocker from the surface of the fibers or reduce its effectiveness, thus making the nylon fibers more susceptible to staining with acid dyes or other materials at a later time. The effectiveness of other treatments such as water repellents and UV absorber applications can also be reduced or eliminated by cleaning agents used to remove staining by mustard and Betadine from nylon fibers after staining of the fibers.

Improved stain resistance after wet cleaning can be achieved by increasing the amount of a SAC stainblocker product initially applied to the substrate. However, this generally leads to discoloration caused by yellowing of the substrate at first application and further discoloration upon exposure to air and light.

A recent patent, U.S. Pat. No. 6,814,758, (the "'758 patent"), the disclosure of which is incorporated herein in its entirety by this reference, purports to impart Betadine resistance to nylon fibers. This patent states that the application of SAC in an amount greater than 2% wt/wt (weight dry SAC/weight dry nylon fiber) in a wet fixing process will provide a fiber that is resistant to staining by Betadine.

While that method may provide some resistance to staining by Betadine, the inventor herein has found that nylon fibers treated with the methods and compositions of the '758 patent still exhibit unacceptable staining by Betadine, as well as mustard. Indeed, it has been found by the inventor herein that the methods and compositions of the '758 patent do not provide Betadine, and mustard resistance as would be found acceptable in many commercial applications.

In light of the above, it would be desirable to identify methods and compositions to provide improved resistance to staining by disperse dyes, such as mustard and Betadine. Still further, it would be desirable to identify methods and compositions that would provide such resistance without undesirable yellowing caused by the application of high amounts of SAC-type stainblocker chemicals to the fibers. The present invention provides such improvements.

SUMMARY OF THE INVENTION

The invention provides nylon materials, for example, nylon 6 and nylon 6,6 fibers, yarns and carpets, having resistance to staining by a wide variety of staining agents including, but not limited to neutral colorants such as, Betadine®, i.e., a 10% povidone-iodine solution, and mustard. The present invention also provides nylon materials with resistance to staining by other types of staining agents, such as, for example, coffee, Kool-Aid® and red wine. The present invention also provides methods of imparting stain resistance to nylon materials. One or two exhaustible compositions can be applied either from an exhaust bath application or by a continuous application method. Whether one or two exhaustible compositions are applied, the invention provides a topical treatment step after the application of the exhaustible composition(s).

Additional advantages of the invention will be set forth in part in the detailed description, which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory aspects of the invention, and are not restrictive of the invention, as claimed.

BRIEF DESCRIPTION OF THE DRAWINGS

This patent or application file contains at least one drawing executed in color. Copies of this patent or patent application publication with color drawings will be provided by the U.S. Patent and Trademark Office upon request and payment of the necessary fee.

FIG. 14 is a summary of the stain resistance data in Tables 5A, 5B, 5C and 5D.

DETAILED DESCRIPTION OF THE INVENTION

Figure 1:
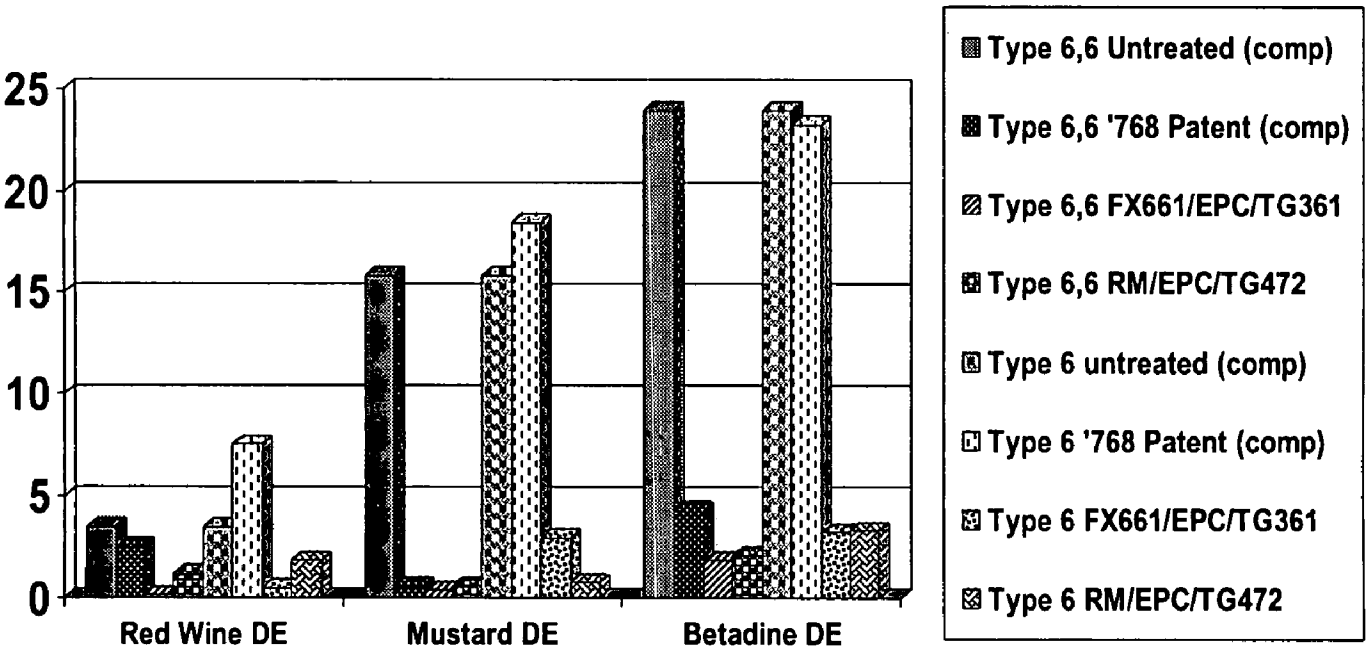
FIG. 1 shows a comparison of staining between the methods of the '758 patent and the inventive methods for Betadine, mustard and red wine staining.

The present invention may be understood more readily by reference to the following detailed description of the invention and the examples provided herein and the Figures discussed herein. It is to be understood that this invention is not limited to the specific methods, formulations, and conditions described, as such may, of course, vary. It is also to be understood that the terminology used herein is for the purpose of describing particular aspects only and is not intended to be limiting.

In this specification and in the claims that follow, reference will be made to a number of terms, which shall be defined to have the following meanings.

The singular forms "a," "an," and "the" include plural referents unless the context clearly dictates otherwise.

Ranges may be expressed herein as from "about" one particular value and/or to "about" or another particular value. When such a range is expressed, another aspect includes from the one particular value and/or to the other particular value. Similarly, when values are expressed as approximations, by use of the antecedent "about," it will be understood that the particular value forms another aspect.

"Optional" or "optionally" means that the subsequently described event or circumstance may or may not occur, and that the description includes instances where said event or circumstance occurs and instances where it does not. For example, the phrase "optionally comprising water" means that the composition may comprise water and that the description includes both compositions comprising water and compositions without water.

"Resistant to staining by a 10% povidone-iodine solution" means that a nylon fiber, yarn or carpet treated according to the invention exhibits at least a 40% less staining, where such staining is measured by % difference in the Delta E CMC values using an untreated sample exposed to the same staining agent for a comparative Delta E CMC. Such a povidone-iodine solution is known commercially as "Betadine" and is a product of Purdue Pharma, LP. (Stamford, Conn.).

As would be recognized by one of ordinary skill in the art, Betadine is the most used antiseptic for patient care in hospitals. Thus, it is quite common for carpet products used in hospitals to become stained by inadvertent spillage of Betadine during patient care. Accordingly, purchasers of carpets for use in commercial settings frequently use resistance to Betadine as a performance requirement. It can therefore be important for a manufacturer to be able to demonstrate Betadine resistance in order to sell a carpet for use in a commercial environment.

To test resistance to staining by Betadine (that is, the 10% povidone-iodine solution), a modified version of the AATCC TM 175 test (incorporated by reference herein) is used by the inventor herein. This modification is believed to be widely used by carpet manufacturers to test Betadine resistance in carpet. Also, a modified AATCC TM 175 test was disclosed in the '758 patent to demonstrate the efficacy of the treatments disclosed therein.

The modification of AATCC TM 175 to test Betadine stain resistance by the inventor herein is set forth herein in Example 1. To summarize the method, Betadine is applied to a nylon material, such as a carpet swatch. The stain is allowed to sit for a period of time (i.e., 24 hours) and the sample is rinsed, extracted and dried. The amount of stain is measured using a spectrophotometer. The difference between the stained area and an unstained area of the same sample is the Delta E CMC, which provides a measure of the staining or lack thereof for a nylon material treated with the compositions and methods of the present invention, as well as that of comparative examples.

For light colored fibers, the actual Delta E CMC can be presented to assess Betadine resistance as well as resistance to other types of stains. A lower actual Delta E CMC on a light colored treated sample can serve as a measure of stain resistance. That is, stains such as mustard, Betadine and red wine will be very visible on light colored fibers. Further, yellowing (often caused by stainblocker materials) will be more visible on a light colored material. Thus, the actual Delta E CMC can allow assessment of staining for such light colored material.

When a dark colored nylon material is stained, however, the staining agent may not be as visible. Nonetheless, such staining is normally visible in some amount and, as such, it is necessary to test dark colored nylon materials for stain resistance, also. The inventor herein has determined that a percent difference in Delta E CMC can serve as a good gauge of stain resistance provided by a particular treatment, especially when dark colored substrates are tested for stain resistance.

In one aspect, the present invention provides an improvement of at least 40% (as measured by Delta E CMC) over an untreated sample stained with the same staining agent. Still further, the present invention provides an improvement of at least 50% (as measured by Delta E CMC) over an untreated sample stained with the same staining agent. Yet still further, the present invention provides 60% (as measured by Delta E CMC) over an untreated sample stained with the same staining agent.

To clarify how the percentage reduction is calculated, the following is presented:

Let X equal the Delta E CMC value obtained by measurement of Betadine stained area on an untreated control sample of material.

Let Y equal the Delta E CMC value obtained by measurement of Betadine stained area on a sample of the same material as above, with the exception that this material has been treated with a stain resist system.

The percentage improvement in the staining would be given by the value Y divided by the value of X, then multiplied by 100. The resulting value would then be subtracted from 100, to give the percentage improvement.

If X equals 70 Delta E CMC units, and Y equals 20 Delta E CMC units, then the percentage improvement would be given by 100−(20/70)−100) or 71.42% improvement.

"Resistance to staining by mustard" means that the nylon material, i.e., fiber, yarn or carpet, exhibits resistance to staining by a mustard solution. The mustard modification to AATCC TM 175 is set forth herein in Example 1. As with the Betadine staining resistance modification discussed above, the resistance to staining by mustard is measured using a spectrophotometer. A stained area of the sample of interest is compared to an unstained area of the same sample to provide a Delta E CMC value. As with Betadine stain resistance, both the actual Delta E CMC and the percentage reduction in Delta E CMC, as compared to an untreated control sample, have been found to be good measures of the effectiveness of the treatments herein.

In understanding the significance of the following examples, it is usefil to understand the following principles of the 1976 CIE L*, a*, b* system. The system assigns color coordinates along three axes in three dimensional color space. The three axes are named L*, a* and b*. The L* value is a measurement of the depth of shade (lightness-darkness). An L* value of 100 is pure white and 0 is pure black. Therefore, the lower the L* value the darker the shade. AΔ.L* value of 1 is barely visible to the naked eye viewing the samples side-by-side. AΔ.L* value of 4-5 is significantly different. The a* axis represents red and green. Negative a* values are green and positive values are red. The absolute value of the a* value rarely exceeds 20.

The b* axis represents yellow and blue. Negative b* values are blue and positive values are yellow. The absolute value of the b* value rarely exceeds 20.

Once the absolute L*, a*, and b* values have been obtained for a sample, and a reference standard for comparison with the sample, the color difference equations are used to derive a total difference value, which is a summation of the differences measured on the three axis described above, this value is referred to as the DE value. Modifications to the color difference equations were made by researchers in order to make the color difference values derived by the above measurement technique correlate better with the opinions of a significant population of human observers. This modified color difference equation gives the total color difference result as a value referred to as the DE CMC. The DE CMC color difference equation offers the possibility of changing the weighting of the difference in the lightness/darkness, or Delta L* value, and the red/green difference (Delta a*), and yellow/blue difference (Delta b*) values. The typical weighting factor used for the DE CMC color difference calculation is 2:1, meaning that differences along the red/green and yellow/blue axis are weighed twice as much as differences along the light/dark axis. The values in this work have been derived using the DE CMC color difference equation, with a 2:1 weighting factor.

"Stainblocker" means materials which, when applied to nylon fibers, improves the resistance of such fibers to staining when the fibers come into contact with acid dye colorants (e.g. Red Dye No. 40). Such materials are known to one of ordinary skill in the art.

In one aspect, the present invention relates to a method of imparting resistance to staining by Betadine and mustard to nylon material comprising the steps of: applying to the nylon material one or more of a stainblocker or an exhaustible polymer composition followed by application of a topical treatment composition to the nylon material, wherein the nylon material treated according to the method herein is resistant to staining by disperse dyeing agents, such as a 10% povidone-iodine solution and/or a mustard solution. Resistance to staining by red wine and other staining agents are also seen with this invention. Additionally, the nylon material treated according to the methods and compositions of the invention generally exhibits acceptable lightfastness.

While it is possible to treat any type of nylon material with this invention, the present invention has been found to be particularly suitable for use on nylon 6 and nylon 6,6 materials. The nylon materials can comprise nylon fibers prepared in accordance with conventional methods of preparing nylon fibers. Such methods are well known to one of ordinary skill in the art and are not discussed in detail herein. The nylon fibers can be colored prior to or in conjunction with the treatments of the present invention. When colored prior to application of the compositions discussed herein, the fibers can be dyed with conventional exhaust dyes after extrusion of the nylon into fibers, either prior to or after the fibers are formed into yarn or woven into carpet. The fibers can also be colored during the extrusion process, that is, by solution dyeing.

Further, as mentioned above, cationic dyeable nylon is often used where resistance to acid stains is desired. However, cationic dyeable nylon is not resistant to disperse dyeing agents such as Betadine and mustard. The compositions and methods of the present invention can be used with cationic dyeable nylon also to provide a cationic dyeable nylon with resistance to disperse dyeing agents. Cationic nylon can be dyed using cationic dyes, acid dyes or disperse dyes or fiber reactive dyes, as well as colored using pigments during the process of fiber extrusion.

After extrusion of the nylon into fibers, the fibers are generally formed into yarn, in particular, a bulked continuous filament yarn, or a staple yarn, in accordance with methods known to one of ordinary skill in the art. The yarn can be treated in accordance with the present invention, followed by tufting into carpet, or the yarn can first be incorporated into a carpet followed by treatment accordance with the present invention. The methods of incorporating the fibers, yarns etc. into carpet are not critical to the invention and, as such, will not be discussed in detail herein. The fibers and yarns can also be incorporated, for example, in non-woven carpet products. Again, such methods are not critical to the present invention and will not be discussed in detail herein.

The stainblocker can be used either alone or in combination with the exhaustible polymer composition. In accordance with the methods and compositions of the present invention, the topical treatment composition must be applied after application of the one or more exhaustible polymer compositions, however.

In one aspect, the method of the present invention consists essentially of steps a) and b), where step a) is the application of the stainblocker and/or exhaustible polymer and step b) is application of the topical treatment composition.

A wide variety of stainblockers are suitable for use in the invention. A detailed review of stainblockers is set forth in U.S. Pat. No. 6,802,870, the disclosure of which is incorporated herein in its entirety by this reference. Particular stainblockers suitable for use in the present invention include, but are not limited to, N 201A and DGF 30, (Simco Products, Greenville, S.C.). N 201 A and DGF 30 are believed to be aqueous dispersions of sulfonated aromatic condensate materials. N 201A is described in the '758 patent, incorporated elsewhere herein. As disclosed in that patent, N 201A is a 30% SAC solids product. It is believed that DGF 30 is a lower concentration of SAC than N 201A. This belief is borne out by the experimental results (FIGS. 2-7) herein which show a slightly reduced Betadine stain resistance when DGF 30 is used.

In further aspects, the following stainblockers, all products of 3M Innovative Products (Minneapolis, Minn.) can be used: FX661 stain resist (believed to be a blend of phenolic condensate, and a methacrylic acid-containing multipolymer system), FX668F stain resist (believed to be a methacrylic acid containing multipolymer system) and 3M FX657 stain resist (believed to be a copolymer of methacrylic acid and phenolic moiety). Each of these 3M stainblocker products are believed to comprise methacrylic acid polymer or copolymer and are believed to be described in at least U.S. Pat. Nos. 4,937,123 and 4,822,373, the disclosures of which are incorporated herein in their entireties by this reference.

A further stainblocker that can be used is Sitefil 90, a product of Peach State Labs, (Rome, Ga.). It is currently believed that this stainblocker material is an ultra low molecular weight inner-penetrating polymer network co-reacted terpolymer containing dodecyl diphenyl oxide, methacrylate/acrylic acid anionic polymer.

A yet further stainblocker that can be used in the present invention is RM, also a product of Peach State Labs. It is currently believed that RM is a high molecular weight, low OH-containing phenyl/phenol sulfonic acid condensation.

Another useful stainblocker for the invention herein is LFS 30F from Peach State Labs. The LFS 30F is believed to be a polymer system containing sulfoisopthalic acid moieties.

Yet another stainblocker suitable for use herein is CRM, also a product of Peach State Labs. CRM is believed to be a blend of the Peach State Labs RM stainblocker and proprietary antioxidants.

The stainblocker can be added to the fiber at from about 0.1 to about 10% owf (on weight fiber). As would be recognized by one of ordinary skill in the art, "owf" means the amount of solids applied per dry weight of the fiber. Therefore, a stainblocker applied at 5% owf to 10 grams of fiber will have 0.5 grams of stainblocker as measured by stainblocker solids on dry fiber weight. Yet still further, stainblocker can be applied at from about 2.0 to about 6.0% owf. Still further, the stainblocker can be applied at from about 0.1, 0.5, 1.0, 2.0, 3.0, 4.0, 5.0, 6.0, 7.0 8.0, 9.0 or 10.0% owf, as measured by stainblocker solids on dry fiber weight where any value can be used as an upper or a lower endpoint, as appropriate.

The stainblocker can be applied at a pH of about 1.0 to about 6.0, or from about 1.6 to about 4.5, or from about 1.5 to about 3.0. Still further, the stainblocker can be applied at a pH of from about 0.5, 1.0, 1.5, 2.0, 2.5, 3.0, 3.5, 4.0, 4.5, 5.0, 5.5 or 6.0, where any value can be used as an upper or a lower endpoint as appropriate.

As would be understood by one of ordinary skill in the art, high amounts of SAC-containing stainblocker can cause color change of the fibers in use. For light colored fibers, it may be desirable to lessen the amount of stainblocker or use a non-SAC-type stainblocker. Excellent Betadine resistance (as well as mustard and red wine resistance) with minimal color change (as measured by the Xenon lightfastness measurements discussed herein) is seen with use of the stainblocker and/or exhaustible polymer composition together with the topical fluorochemical treatment is provided by the present invention even when a SAC-type stainblocker is used.

The stainblocker treatment composition can include a crosslinking agent such as antimony potassium tartrate. Several commercially available cross-linking agents are suitable for use in the present disclosure. Suitable commercially available cross-linking agents include, but are not limited to, antimony potassium tartrate ("APT") commercially available from Lenmar Corporation (Dalton, Ga.). The aqueous treating composition of the present disclosure can contain at least one cross-linking material, wherein the preferred cross-linking material is APT for wet fixation applications.

The amount of cross-linking material in the aqueous treating compositions of the present disclosure can vary depending on a number of factors including, but not limited to, the type of application (i.e., wet or dry fixation application), the other components used in the aqueous treating composition and the type of fiber and/or carpet yarn treated. The cross-linking material can be present in the aqueous treating composition in an amount ranging from about 0.001 pbw to about 5.0 pbw cross-linking material, based on a total weight of a given aqueous treating composition.

The stainblocker treatment can also include tannic acid. The aqueous treating compositions of the present disclosure can comprise at least one tannic acid. Tannic acid, also known as gallotannic acid penta-(m-digalloyl)-glucose, has been used in textiles as a mordant, that is, as a chemical that fixes a dye in or on a substance by combining with the dye to form an insoluble compound, and as a fixative. Tannic acids are well known in the art and comprise compounds derived from nutgalls having a structure of polygalloylglucose or polygalloylquinic acid. The term "tannic acid" as used herein refers to tannic acids and products containing tannic acid, such as gallotannin. Suitable tannic acids for use in the present disclosure include, but are not limited to, tannic acids described in U.S. Pat. No. 5,738,688, the disclosure of which is hereby incorporated by reference in its entirety. The tannic acid used in the present disclosure can have a gallic acid content of less than about 3.0 parts by weight (pbw), or less than about 2.0 pbw, or less than about 1.0 pbw, for example, from about 0.1 to about 1.0 pbw, or from about 0.2 to about 0.4 pbw.

Tannic acid suitable for use herein is described in co-pending U.S. patent Ser. No. 10/627,945. The disclosure of which is incorporated herein in its entirety by this reference.

Several commercially available tannic acids are suitable for use in the present disclosure. Suitable tannic acids include, but are not limited to, tannic acid powders commercially available from Aceto Corporation (Lake Success, N.Y.) under the trade designations ASP powder and 3SP powder; tannic acid solution commercially available from Bayer Corporation (Baytown, Tex.) under the trade designation BAYGARD® CL Liquid; and tannic acid powder commercially available from Clariant Corporation (Charlotte, N.C.) under the trade designation CLM Powder.

The amount of tannic acid in the aqueous treating compositions of the present disclosure is provided to produce a desired level of tannic acid on the nylon material. The tannic acid can be present in the aqueous treating composition in an amount of up to about 0.5 parts by weight (pbw), based on a total weight of the aqueous treating composition. The tannic acid can also be present in an amount ranging from about 0.005 pbw to about 0.4 pbw tannic acid, based on a total weight of the aqueous treating composition.

An exhaustible polymer composition can also be applied to the nylon fiber. Such a material can be applied either alone or in combination with the stainblocker material as discussed above. When used with the stainblocker, the stainblocker is applied first. The inventor herein has found that when the exhaustible polymer application is required to provide suitable stain resistance, the most effective application is to apply the stainblocker and exhaustible polymer in separate baths, in separate application and fixation steps. However, whether the exhaustible polymer system is used with the stainblocker or alone, or vice versa, the topical treatment composition will always follow as a final step.

In one aspect, the exhaustible polymer composition can comprise the compositions disclosed in U.S. Pat. No. 6,524,492 (the "'492 patent"), the disclosure of which is incorporated in its entirety by this reference. As disclosed in the '492 patent, the combinations therein provide superior exhaustion of polymer onto nylon fibers. It is currently believed that a commercially available composition conforming to the disclosure of the '492 patent is 52 DM, a product of Peach State Labs.

In further separate aspects, the exhaustible polymeric materials can comprise, Cibafix ECO from Ciba Specialty Chemical, (Tarrytown, N.Y.), Coupler B from Simco, Cekafix SUE-200 from Cekal Specialty Chemicals, (Mt. Holly, N.C.). According to U.S. Pat. No. 5,417,724, the disclosure of which is incorporated in it's entirety by this reference, Coupler B is a cationic polyamine polymer which is used as a cotton dye fixing agent. According to the manufacturer, Cibafix ECO is a modified cationic polyamine derivative.

The exhaustible polymer composition can be added to the fiber at from about 1.0 to about 10.0% owf as measured by weight solids on dry fiber. Yet still further, the exhaustible polymer composition can be applied at from about 2.0 to about 6.0% owf. Still further, the exhaustible polymer composition can be applied at from about 1.0, 2.0, 3.0, 4.0, 5.0, 6.0, 7.0 8.0, 9.0 or 10.0% owf as measured by weight solids on dry fiber, where any value can be used as an upper or a lower endpoint, as appropriate.

The exhaustible polymer composition can be applied at a pH of about 1.0 to about 6.0, or from about 1.5 to about 3.0. Still further, the exhaustible polymer composition can be applied at a pH of from about 0.5, 1.0, 1.5, 2.0, 2.5, 3.0, 3.5, 4.0, 4.5, 5.0, 5.5 or 6.0, where any value can be used as an upper or a lower endpoint, as appropriate.

Use of both the stainblocker and exhaustible polymer composition along with the topical treatment composition (discussed below), has been found to be especially beneficial when lower stainblocker amounts are used and/or when nylon 6 fibers are being treated.

As would be understood by one of ordinary skill in the art, nylon 6 fibers are less crystalline than nylon 6,6. The less crystalline nature and, thus, more amorphous, nature of nylon 6 makes it more likely that Betadine (as well as other disperse dye staining agents such as mustard) will be better able to penetrate the fiber and cause staining. It has been found by the inventor herein that the Betadine resistance (as well as mustard stain resistance) of nylon 6 fibers can be improved by the combination of application of both the stainblocker and exhaustible polymer composition followed by the topical fluorochemical treatment. With nylon 6,6, however, it has been found that there may be a lesser need to use both the stainblocker and exhaustible polymer composition, although the topical treatment composition is needed to provide disperse dye stain resistance to both nylon 6 and nylon 6,6.

A fluorochemical compound is used in the topical treatment composition. This fluorochemical can be an anionic, cationic or nonionic. The fluorochemical can be either an electrochemically fluorinated fluorochemical or a telomer fluorochemical or any other type of fluorochemical material. The selection of the fluorochemical for the topical treatment is determined by the compatibility of the topical treatment composition with the prior step(s).

In particular, the fluorochemical in the topical treatment composition of the present invention comprises a fluoropolymer. While there are a number of fluoropolymers that could be used in the present invention, it has been found that fluoropolymers having vinyl chloride functionality in the polymer backbone are particularly useful in the present invention. Daikin TG 3530, TG 472 and TG 3361 are currently believed to have this functionality.

A further material suitable for use in the topical treatment of the present invention is WSFR, a product of Peach State Labs. This product is believed to be a perfluoroester-derived fluoropolymer, which is non-ionic to slightly cationic and having a blocked isocyanate cross-linking agent.

As noted, other fluoropolymer materials are suitable for use in the topical treatment step of the present invention. The only limitation on the use of other fluoropolymer types in the topical treatment is that the fluoropolymer be compatible with the previous steps as discussed above. As used herein, "compatible" means that the fluoropolymer improves the stain resistance rating of the treated nylon material. That is, a compatible fluoropolymer suitable for use in the present invention will provide improved stain resistance when applied to a nylon material treated with the stainblocker and/or exhaustible polymer treatment with the topical treatment composition, as compared to the staining results seen on the same nylon material treated with a stainblocker and/or exhaustible polymer without the topical treatment composition. That is, when applied to a nylon material previously treated with either or both the stainblocker and the exhaustible polymer composition, the topical treatment improves the stain resistance rating of the nylon material treated with only the stainblocker and/or exhaustible polymer treatment(s). As noted the improvement in stain rating can be measured by either a % reduction in Delta E CMC values or actual Delta E CMC values as compared to an untreated control.

For example, a first nylon 6 material, such as a carpet sample, can be treated with the stainblocker and the exhaustible polymer composition only. A second nylon 6 carpet greige good sample can be treated with the same stainblocker and exhaustible polymer composition followed by the topical treatment composition. Each treated sample can then be stained (in separate tests) with Betadine, mustard, red wine, Kool-Aid or any other suitable staining material in accordance with the methods set forth in the Examples herein. The amount of staining on the carpet samples can then be measured. An untreated sample of the same material is also stained in the same fashion for reference. The amount of staining is compared between the first, second untreated, unstained sample is taken using the spectrophotometric method discussed in the Examples. The amount of staining is compared between the first treated sample, the second treated sample and the untreated, unstained sample using the spectrophotometric method discussed in the Examples. The percentage reduction in the Delta E CMC (or absolute reduction) value for the stained areas on the two treated samples are then compared. A topical treatment composition is suitable for use in the present invention when the percentage (or absolute) reduction in the Delta E CMC value of the topical treatment composition treated sample is greater than that of the sample with no topical treatment composition, where both samples are treated with the same stainblocker and/or exhaustible polymer treatments in step a.

Figure 5:
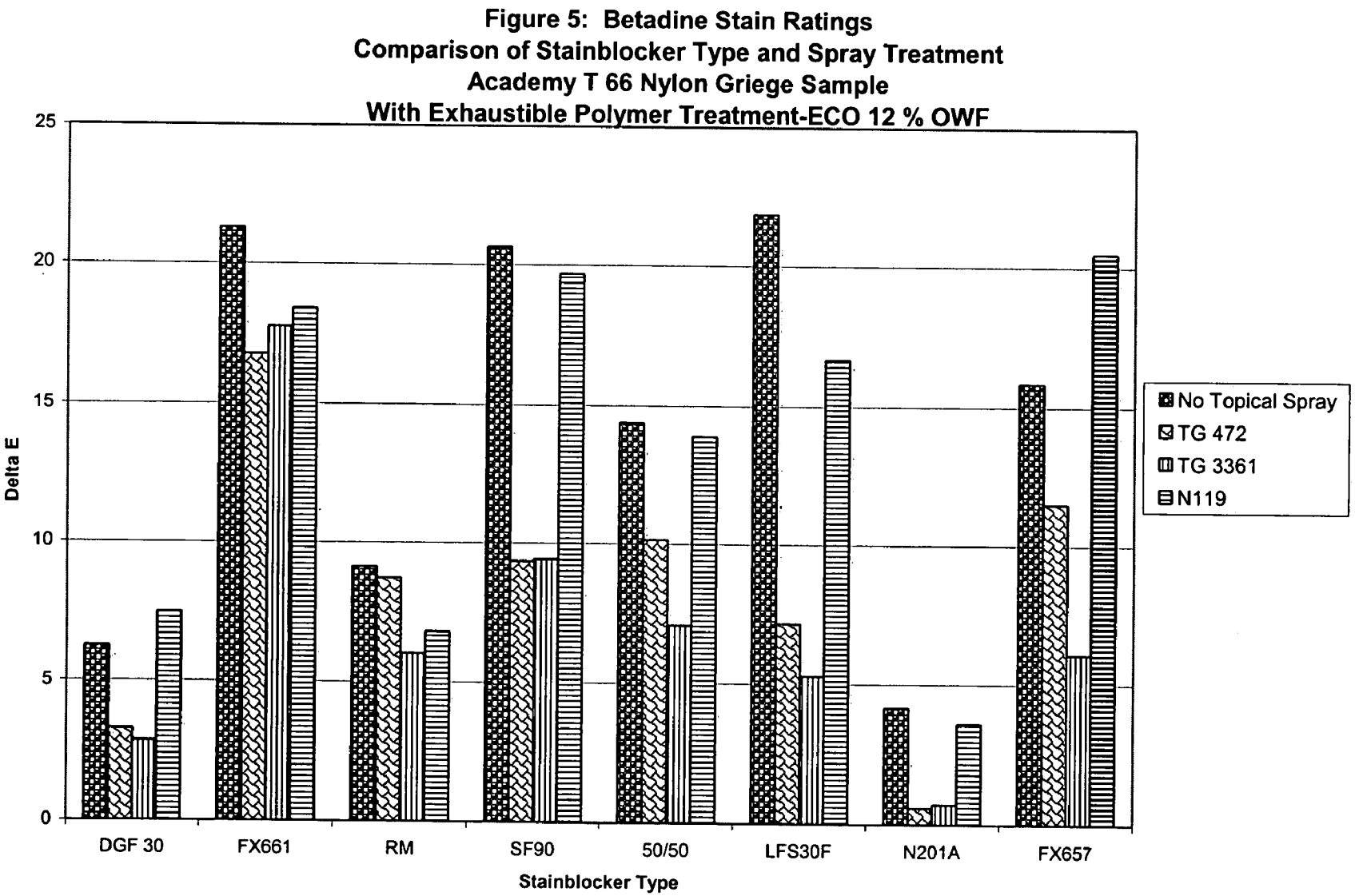
FIG. 5 shows a comparison of Betadine stain ratings (Delta E CMC) for different stainblocker types and topical treatment compositions for nylon 6,6 carpet samples. These samples each have exhaustible polymer treatment of ECO 12% OWF.
Figure 6:
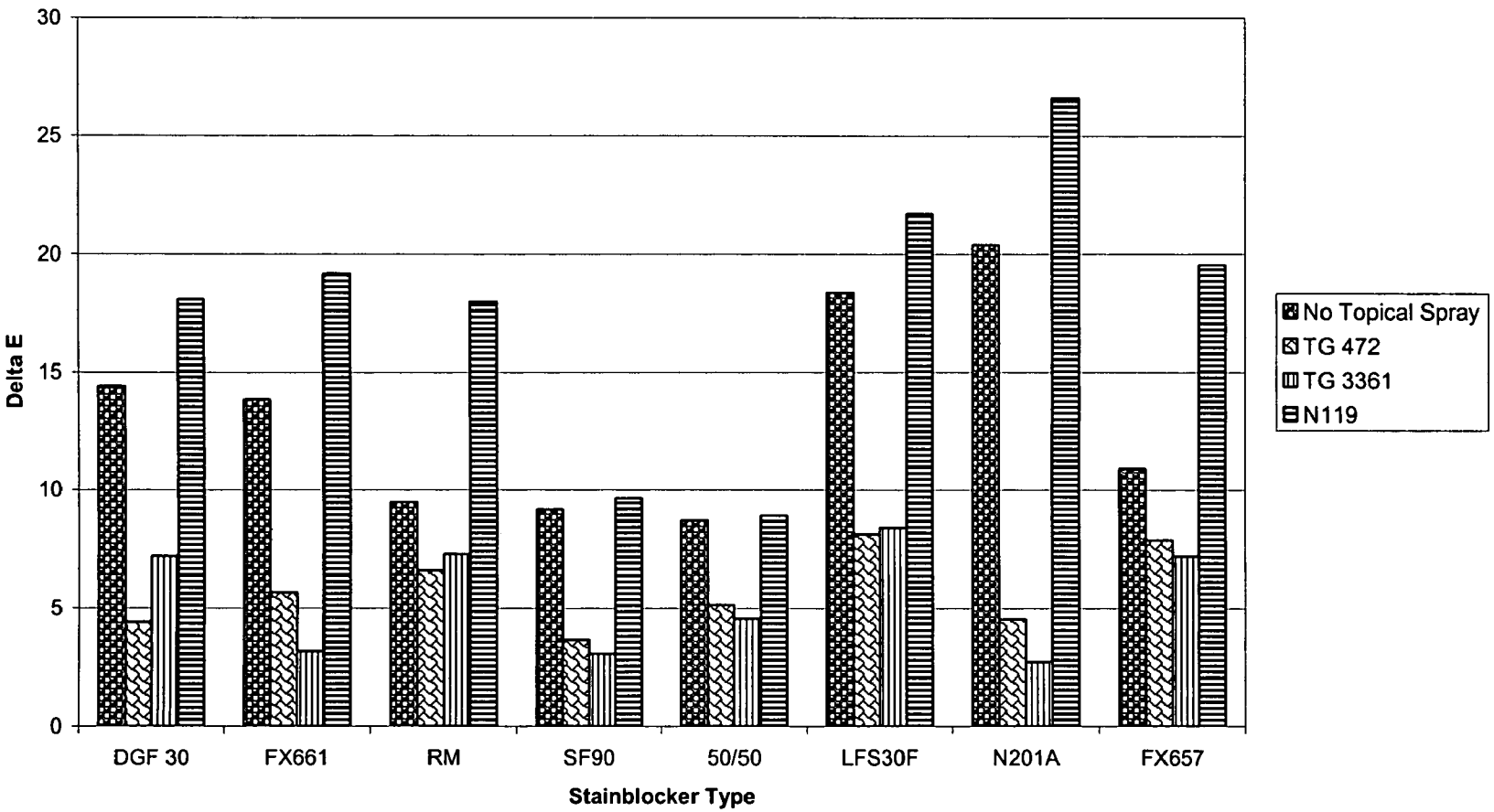
FIG. 6 shows a comparison of Betadine stain ratings (Delta E CMC) for different stainblocker types and topical treatment compositions for nylon 6 carpet samples. These samples each have exhaustible polymer treatment of 52 DM 12% OWF.
Figure 7:
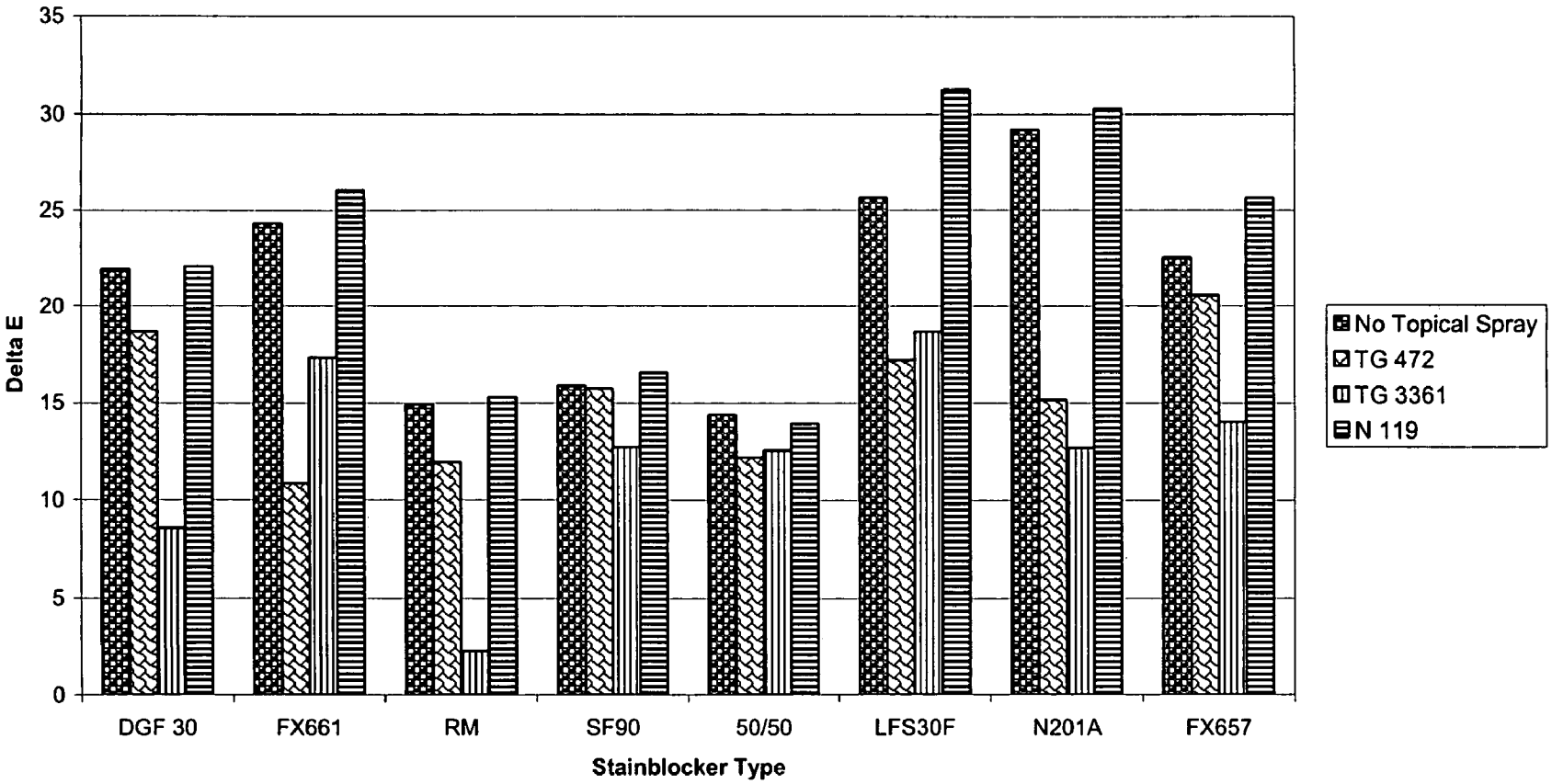
FIG. 7 shows a comparison of Betadine stain ratings (Delta E CMC) for different stainblocker types and topical treatment compositions for nylon 6 carpet samples. These samples each have exhaustible polymer treatment of ECO 12% OWF.
Figure 8:
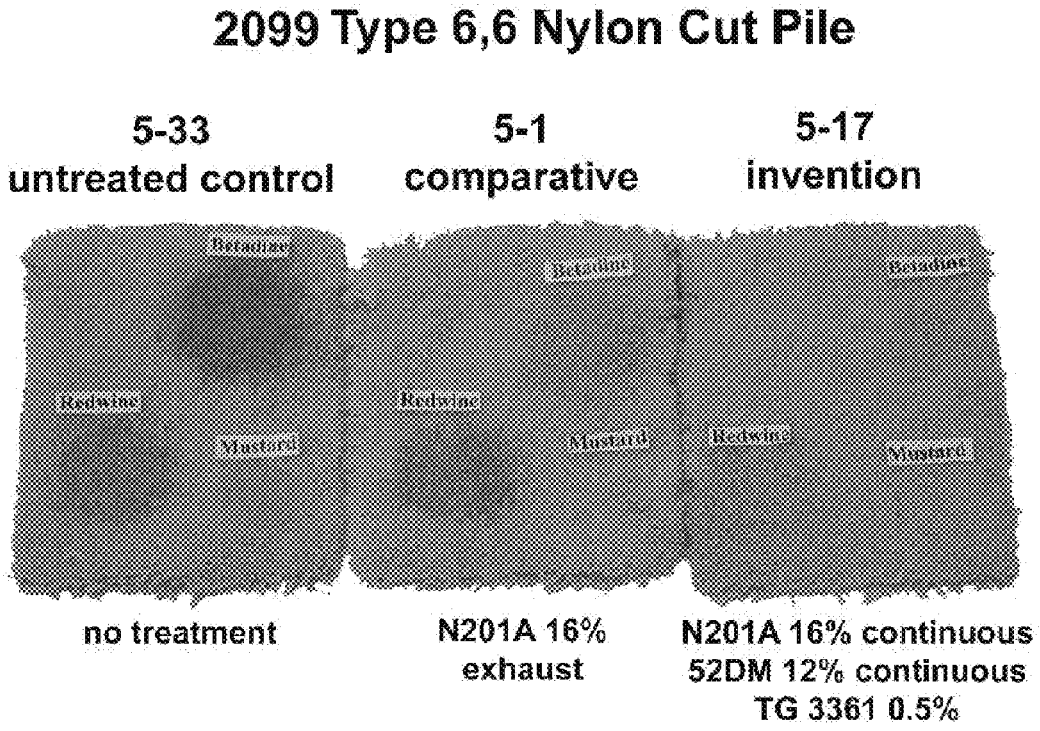
FIG. 8 is a color photograph of Betadine, mustard and red wine staining on 2099 Type 6,6 cut-pile nylon carpet. The stainblocker tested is N201A.

To illustrate, FIGS. 5-7 show comparisons of Betadine resistance with various treatment conditions. In all comparisons, except for the data set identified as "50/50": which is a stainblocker treatment of 50% DGF 30/50% Sitefil 90, the topical spray identified as "Ni 19" provides a greater Delta E CMC value for Betadine stain resistance than the samples marked "no topical spray." This data indicate that, with the exception of the 50/50 stainblocker treatment, the fluoropolymer Ni 19 is not compatible with the stainblocker and exhaustible polymer treatments therein. Ni 19, which is supplied by E. I. du Pont Demours (Wilmington, Del.), is believed to be a telomer urethane-derived Flouropolymer.

Without being bound by theory, it is believed that the variables present in the present invention include at least fiber type, stainblocker type, exhaustible polymer composition and topical treatment composition. While it will require some experimentation to determine the optimum combination to provide stain resistance, such combinations can be determined by one of ordinary skill in the art without undue experimentation.

The topical treatment can be applied such that the amount of fluorochemical applied from the topical treatment composition can be from about 0.001% to about 1.0% by weight of dry solids on fiber. Still further, the amount of fluorochemical applied from the topical treatment composition can be from about 0.05% to about 0.5% by weight of dry solids on fiber. Still further, the amount of fluorochemical applied from the topical treatment composition is from about 0.001, 0.005, 0.01, 0.05, 0.1, 0.5, or 1.0% by weight of dry solids on fiber where any value can be used as an upper or a lower endpoint, as appropriate.

The stainblocker and/or exhaustible polymer composition can be applied to the nylon fiber, yarn or carpet (that is, the nylon material) in accordance with the methods known to one of ordinary skill in the art. (For purposes of this discussion related to the methods of application, the stainblocker and exhaustible polymer system composition treatments are collectively referred to as "exhaustible compositions.") In particular, the exhaustible compositions can be applied to the nylon material by immersing a yarn prepared from nylon fibers in the respective exhaustible compositions. Alternatively, the nylon material can be immersed a bath of the respective exhaustible compositions. In yet another method, the nylon material can be placed in a vessel containing the respective exhaustible compositions, such as a dyeing vessel. Still further, the respective exhaustible compositions can be sprayed or cascaded onto the nylon material to result in immersion of the carpet.

In one aspect of the present invention, the exhaustible composition is/are prepared by mixing the desired ingredients together. The exhaustible compositions can be prepared as a batch, in a holding tank, for delivery to the application equipment, or, alternatively, may be prepared in a continuous mixing fashion, for direct application, with no need for a holding vessel for making the batch mixture, by using pumps, flow meters and static or dynamic mixing equipment.

The application baths containing the exhaustible compositions can be applied to the nylon material at from about 100% to about 8000% wpu (wet pick up). Still further, the exhaustible compositions can be applied at from about 50, 100, 200, 300, 400, 500, 600, 700 or 800, 1000, 2000, 3000, 5000, or 8000% wpu, where any value can be used as an upper or lower endpoint, as appropriate. Application baths for continuous application equipment are typically applied in the range of about 100% to about 800% wpu or from about 200% to about 400% wpu. For exhaust application equipment, the % wpu values can range from about 800% wpu to as high as about 3000% wpu, or from about 1000% to about 3000% wpu.

As would be recognized by one of ordinary skill in the art, the actual amount of stainblocker and/or exhaustible polymer composition deposited on the fibers, yarn or carpet, that is the nylon material, from the respective exhaustible compositions will be dependent not only on the wet pick up, but also the amount of stainblocker and exhaustible polymer amounts present in the exhaustible compositions. These deposited amounts can be as stated previously. These deposited amounts refer to the amounts of the various materials that the nylon material is exposed to during the application process. This differs from the amount of the various materials that can be exhausted onto the nylon material. The amounts of materials that can actually be exhausted onto the nylon material will generally be less than the total amount of treatment materials that the fibers have been exposed to, and these levels actually found on the nylon materials will be a function of the exhaustion rates for the various materials being applied.

In further aspects, the exhaustible compositions can be heated to enhance the uptake thereof. It has been found that a heating step can reduce the time needed to get the stainblocker and/or exhaustible polymer system (or any other material) to deposit on the fiber, yarn or carpets.

In one aspect, the exhaustible compositions are applied using a continuous system. One example of such a continuous system is the Küster Fluidyer System, a product of Küsters GmbH (Krefield, Germany). The inventor herein has surprisingly found that, in some aspects, the wet fix methods of the '758 patent do not provide suitable stain resistance when applied using a continuous application system. This is a significant discovery because continuous application systems are the most common systems used in textile manufacture. Thus, although the '758 patent method provides some resistance to staining by Betadine (although the inferiority of such stain resistance is discussed in more detail herein), the '758 patent is not suitable for use in continuous application systems to provide suitable stain resistance for certain treatment combinations. The invention herein therefore provides a more cost effective method to impart resistance to staining by Betadine (as well as other staining agents).

After application of either or both of the exhaustible treatments, the nylon material can be rinsed to remove unexhausted materials. The rinsing step may be done by any conventional means. Typically, warm water having a water temperature of about 60° C. (140° F.) is used to rinse the nylon material. After rinsing, excess water is desirably removed by conventional means, such as a vacuum extractor. Typically, the water content after extracting is from about 20 to about 30 parts by weight based on a total weight of the nylon material. After excess water is removed from the nylon material, the material may be dried in a flow-through oven prior to application of the topical treatment composition. The nylon material is typically dried at up to about 121.1° C. (250° F.) for about 2 to about 3 minutes.

A heating step is generally desirable to increase the exhaustion rates of compositions to the nylon material. A variety of heating steps may be used to expose the nylon material to a desired amount of heat. In one aspect of the present disclosure, steam having a temperature of about 100° C. (212° F.) is brought into contact with the nylon material to which the exhaustible treatment has been applied for a period of up to about 5 minutes, or, from about 45 seconds to about 3 minutes. Although steam treatment is a desired heating method, other heating methods may be used including, but not limited to, exposing the treated nylon material to hot air, such as in a flow-through oven.

In one aspect, one or more of the exhaustible treatment compositions can be applied at from about 71° C. (160° F.) to about 127° C. (260° F.) for from about 15 seconds to about 60 minutes, or from about 82° C. (180° F.) to about 104° C. (220° F.) for from about 30 second to about 8 minutes. Even further, the heating step is accomplished by exposing the fibers, yarn or carpet with the exhaustible treatment composition to steam at ambient pressure, i.e., 100° C. (212° F.) for up to about 90 seconds (i.e., a wet fixation application).

The topical treatment composition can be applied in a spray or a foam system (e.g. a Lessco foam application system (Lessco Int'l, Dalton, Ga.) or Küster Fluicon). The wpu of the topical treatment composition can be from about 5% to about 100%, or from about 10 to about 50%. Still further, the wpu of the topical treatment composition can be from about 5, 10, 20, 30, 40, 50, 60, 70, 80, 90 or 100%, where any value can be used as an upper or a lower endpoint, as appropriate.

The topical treatment is subjected to a dry fixing method. The temperature of the dry fixing step can be from about 160 to about 320° F., or from about 200 to about 280° F. Still further, the temperature of the dry fixing step can be from about 160, 170, 180, 190, 200, 210, 220, 230, 240, 250, 260, 270, 280, 290, 300, 310 or 310° F., where any value can be used as an upper or lower endpoint, as appropriate. The time of the dry fixing step can be from about 5 seconds to about 10 minutes or from about 20 seconds to about 5 minutes. Still further, the time of drying can be from about 5 seconds, 20 seconds, 40 seconds, 1 minute, 3 minutes, 5 minutes, 7 minutes, 10 minutes or 20 minutes, where any value can be used as an upper or lower endpoint, as appropriate.

It is significant to note that the present invention provides marked improvements over the methods and compositions of the '758 patent. In particular, as shown in FIG. 1 hereto, the SAC/wet fix treatment of the '758 patent provide significantly higher Delta E CMC values for red wine, mustard and Betadine staining than those treated in accordance with the inventive methods. This higher Delta E CMC value indicates that the methods of the '758 patent result in greater staining, especially in nylon 6 materials. In particular, inclusion of the topical treatment composition will improve the Betadine and mustard stain resistance of both nylon 6 and nylon 6,6 materials over the methods of the '758 patent. The samples of FIG. 1 are described in more detail in Example 2 below.

Various salts (e.g., metal salts) may be used in the present invention to improve the deposition of stainblocker, exhaustible polymers and/or topically applied fluoropolymer to the fiber. Divalent metal salts (e.g., $MgSO_4$) may be used, although good results can also be obtained under certain conditions through the use of monovalent salts or polyvalent salts. Suitable salts for use in the present invention include stannous chloride, LiCl, NaCl, NaBr, NaI, KCl, CsCl, $Li_2$, $SO_4$, $Na_2$ $SO_4$, $NH_4$ Cl, $(NH_4)SO_4$, $MgCl_2$, $MgSO_4$, $CaCl_2$, $Ca(CH\ COO)_2$, $SrCl_2$, $BaCl_2$, $ZnCl_2$, $ZnSO_4$, $FeSO_4$, and $CuSO_4$. Other materials can be added to the compositions as would be known to one of ordinary skill in the art. Other ingredients can be included in each of the compositions and treatments of the present invention. Such materials, and methods of applying the compositions to fibers are described, for example, in U.S. patent application Ser. No. 10/627,945, the disclosure of which is incorporated herein in its entirety by this reference.

EXAMPLES

The following Examples are put forth so as to provide those of ordinary skill in the art with a complete disclosure and description of how the compounds claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° F. or is at room temperature, and pressure is at or near atmospheric.

Example 1

Staining Solutions

Betadine Staining Solution

Betadine® (10% povidone iodine solution from Purdue Pharma, LP (Stamford, Conn.)

Mustard Staining Solution

French's® Classic Yellow Mustard (Parsippany, N.J.)

Ingredients

Distilled Vinegar, water, No. 1 Grade Mustard Seed, Salt, contains less than 2% of Turmeric, Paprika, Spice, and Garlic Powder. www.frenchssfoods.com Red Wine Staining Solution Ernest and Julio Gallo (Modesto, Calif.)

Twin Valley Vineyards

Merlot

Alcohol 13% by Volume

For all of the staining solutions, 100% of the referenced material was used to provide the respective staining solution. Each staining test was conducted as follows:

Staining Test Protocol

1. The test sample (e.g. nylon 6 or nylon 6,6 carpet sample) was placed on a flat, non-absorbent surface.
2. A staining ring (see AATCC TM 175) in the center of the test sample. 20 ml of the staining solution was poured into the center of the ring while using the stain cup. The staining ring was pressed during this step. After all of the staining solution was poured into the staining ring, the top of the stain cup was used to gently tap the carpet 5 times so as to absorb the solution into the carpet. The staining ring was carefully removed.

3. The stained sample was allowed to sit undisturbed for 24±4 hours. The stained sample was kept away from any air draft, heat source or absorbent surface which might have resulted in accelerated drying of the stained surface.
4. The sample was rinsed with flowing tap water (21±6° C.; 70±10° F.) until all unfixed staining agent was removed and the rinse water was clear. The backing was rinsed thoroughly to ensure that the staining agent was removed.
5. Excess water was removed by using a centrifugal extractor or a household washing machine set on the spin cycle with water spray shut off.
6. The test sample was oven dried in a flat position, pile side up, at 100±5° C. (212±9° F.) for 90 minutes maximum.

Nylon Carpet Materials

The following Tables provide details regarding the carpet samples used in the Examples. The first section of each table lists the characteristics of the yarn used; the second section identifies the characteristics of the carpet sample itself.

2099 Greige Carpet Sample (Type 6, 6 Nylon Cut-Pile Construction)

| Component | 23522 |
|---|---|
| Component Color | Natural |
| Threadup Assn | A |
| Oz | 35.3 |
| Denier | 3.40/2 |
| Processing | Twisting |
| Heatset Code | SS |
| Heatset | Singed Superba |
| Polymer Type | Nylon 6, 6 |
| Fiber | 1993 |
| Supplier | Solutia |
| Dye Type | Natural |
| Twist | 5.20 × 5.00 |
| Antistat | Yes |
| Luster | Semi Dull |
| Greige Good | 2099 |
| Color | None |
| Gauge | 1/10 |
| Width | 147 |
| Threadup | A |
| Machine | Level Cut |
| Construction | Cut |
| Stich/6' inch | 74 |
| Pile Height' Inch | 8/32 |
| Cam Front | 3 + 3 |
| Cam Back | None |
| Pattern | None |
| Primary Backing | 24X15 Beige Poly Back |
| Type | PP |
| Vendor | Amoco |
| Width | 152" |

1339/2 - Greige Carpet Sample (Type 6 Nylon Cut Pile Construction)

| Yarn Information Component | 823791 |
|---|---|
| Component Color | Natural |
| Threadup Assn | A |
| Oz | 28 |
| Denier | 1339/2 |
| Processing | Twisting |
| Heatset Code | FN |
| Heatset | Suessen |

-continued

1339/2 - Greige Carpet Sample (Type 6 Nylon Cut Pile Construction)

| Yarn Information Component | 823791 |
|---|---|
| Polymer Type | Nylon 6 |
| Fiber | Nylon 6 |
| Supplier | Shaw |
| Dye Type | Natural |
| Twist | 3.50 × 3.50 |
| Antistat | No |
| Luster | Brite |
| Greige Good | 1339 lab |
| Color | None |
| Gauge | 1/10 |
| Width | 36 |
| Threadup | A |
| Machine | Level Cut |
| Construction | Cut |
| Stich/6' inch | 66 |
| Pile Height' Inch | Aug-32 |
| Cam Front | RD0 |
| Cam Back | RD0 |
| Pattern | None |

Scholar - Carpet Sample (Type 6 Nylon Loop Pile Construction)

| Yarn Information Component | 831549 |
|---|---|
| Component Color | CA573 |
| Threadup Assn | A |
| Oz | 20 |
| Denier | 1353/3 |
| Processing | Air Entangled |
| Heatset Code | FE |
| Heatset | NHS |
| Polymer Type | 754 |
| Fiber | Nylon 6 |
| Supplier | Shaw |
| Dye Type | Solution Dyed |
| Twist | AE |
| Antistat | Yes |
| Greige Good | K291 |
| Color | 310 |
| Gauge | 1/10 |
| Width | May-00 |
| Threadup | A |
| Machine | Textured Loop |
| Construction | Loop |
| Stich/6' inch | 45 |
| Pile Height' Inch | 4 6/32 |
| Cam Front | RD0 |
| Cam Back | RD0 |
| Pattern | None |
| Primary Backing | 001033 |
| Type | Snakeskin |
| Vendor | Amoco |
| Width | 152 |

Academy - Carpet Sample (Type 6, 6 Nylon Loop Pile Construction)

| Component | 917496 |
|---|---|
| Component Color | CB430 |
| Threadup Assn | A |
| Oz | 28 |
| Denier | 1200/3 |
| Processing | Air Entangled |
| Heatset Code | FC |

-continued

| Academy - Carpet Sample (Type 6, 6 Nylon Loop Pile Construction) | |
|---|---|
| Component | 917496 |
| Heatset | NHS |
| Polymer Type | T6, 6 |
| Fiber | Nylon 6, 6 |
| Supplier | Universal |
| Dye Type | Solution Dyed |
| Twist | AE |
| Antistat | Yes |
| Greige Good | K335 |
| Color | 00100 |
| Gauge | 1/10 |
| Width | 144 |
| Threadup | A |
| Machine | Textured Loop |
| Construction | Loop |
| Stitch/6' inch | 68 |
| Pile Height' Inch | 5 7/32 |
| Cam Front | RD0 |
| Cam Back | RD0 |
| Pattern | None |
| Primary Backing | 001033 |
| Type | Snakeskin |
| Vendor | Amoco |
| Width | 152 |

Dyeing Information

For the Academy and Scholar materials, no dyeing was required, since these were melt colored products. For the 2099 T66 Superba set greige, and the 1339 T6 Suessen set greige, these required dyeing, prior to the addition of the exhaustible polymer and topical treatments. The dyeing parameters for both the 2099 and 1339 materials were as follows:

Continuous dyeing simulation—400% wpu 5 minutes steaming time

Dyebath chemicals—

STS—0.05 g/l

EDTA—0.25 g/l

10% active silicone defoamer—0.25 g/l

DOSS 70—1.0 g/l

Phosphoric Acid 75%—to pH 5.5

Dyes Used:

Tectilon Orange TC 200—0.026% owf

Telon Red 2BN 200—0.021% owf

Telon Blue BRL 200—0.047% owf

Resulting shade is a very light grey

Measurement of Delta E CMC

The color difference measurements have been made using the Macbeth 7000A ColorEye® spectrophotometer. The instructions for operating this device are provided by the manufacturer, and are incorporated herein in their entirety by this reference. Carpet samples were treated with the compositions and treatments of the present invention as discussed in more detail herein. Comparative examples were prepared also. For each carpet sample, a reference spectrophotometric measurement was taken. This value was recorded as the measurement of an unstained area on the untreated sample. For each inventive example and comparative sample, one or more staining procedures were conducted as discussed above. A spectrophotometric measurement was taken of each of these areas exposed to the various staining agents on these stained samples. The Delta E CMC for each sample was calculated using the color difference equations contained in the software package for the Macbeth 7000A spectrophotometer.

For light colored loop pile carpet samples, an excellent stain resistance was determined to result from a Delta E CMC of 2 or below. A good stain resistance was determined to result from a Delta E CMC of 6 or below. An acceptable stain resistance was determined to result from a Delta E CMC of 10 or below.

Preparation of Exhaustible Compositions

With regard to the exhaustible treatments, the stainblocker bath (step 1) and the polymer system bath (step 2) were made as follows:

400% wpu application was used for these baths, meaning that for every 10 grams of greige carpet stock, 40 grams of treatment bath were applied. The components are listed below in order of their addition to the bath. The component amounts are indicated using % owf values. A value of 1% owf, applied using a 400% wpu bath, required a concentration of 2.50 grams per liter of application bath. The calculation was as follows:

1 gram of additive/100 grams of fiber*100 grams of fiber/0.4 liters of bath=2.5 grams of additive per liter of bath The final step in the preparation of the stainblocker and polymer system baths was the adjustment of the bath pH. The pH parameters for each step were as indicated, typically, for the exhaustible treatments, the pH was 1.6, and the topical treatment pH's ranged from 3.5 to 5.5 units.

Application of Exhaustible Treatment Baths to Greige Carpet Sample ("Continuous Simulation")

The bath was applied by pouring the application bath into a rectangular stainless steel application pan. After the bath was poured into the pan, the carpet sample to be treated was placed pile side down into the application pan. The greige carpet sample was then pressed into the pan with a lid, to work the treatment bath into the carpet sample and the fibers therein. Once fully wet out with the application bath, the carpet sample was placed in the horizontal steamer, and exposed to steam. For the first bath containing the stainblocker, the dwell time was a total of five minutes, for the second bath, 2 minutes dwell time was used. The sample was steamed for 50% of the dwell time in the pile side up position, than the sample was turned to the pile down position, and steamed for the remaining 50% of the dwell time.

After steaming, the sample was rinsed using running tap water, then the remaining water was extracted using a Bock centrifuge.

The above procedure was used for any of the continuous dyeing application simulations indicated in the Examples.

For Ahiba exhaust simulations, the % wpu was increased from 400%, to 2200%. The value of 2200% wpu can also be expressed in terms of liquor to goods ratio, of 22:1. For the Ahiba method, the heating of the bath was conducted by immersion of a glass tube that contained the greige and application liquor into an oil bath. The oil bath was heated by indirect electric elements to the desired temperature, for the hold time. For the Ahiba treatments, the temperature was 180° F., and the hold time was 20 minutes. The carpet sample was mounted on a fork holding element, which served to allow a rotational movement of the material in the application bath.

Preparation and Application of Topical Treatment Compositions

For the topical treatment composition, the same type of calculations were conducted, and bath assembly methods used, as described for the continuous application, with the exception that the lab system used a bath application volume of 40% wpu. The topical treatment composition was sprayed onto the carpet material, using a conventional laboratory hand sprayer. The weight of the greige carpet material was first measured, and the weight of the solution applied was measured, such that the target % wpu was obtained.

After application of topical treatment composition, the treated greige carpet materials were dried in a flow through oven at 230° F. for five minutes.

After drying, the treated samples were allowed to condition at standard relative humidity and temperature for 24 hours, prior to any testing.

Example 2

Carpet Samples Tested

Type 6,6 Nylon Academy Carpet (Light beige color) (Shaw Industries Group)

Type 6 Nylon Scholar Carpet (Medium green color) (Shaw Industries Group)

Treatment Conditions (all % Owf were Based on the Wet Material Applied to Dry Fiber)

A. (Comparative) (1 Step Treatment)

Type 6,6 Nylon Academy Carpet treated with DGF 30 stainblocker (proprietary SAC composition supplied by Simco Products believed to be about 30% solids) at 16% to provide about 4.8% of dry SAC solids. No topical treatment composition applied. (Per '758 patent)

B. (Inventive) 3 Step Treatment

Type 6,6 Academy carpet treated with FX661 stainblocker (3M Innovative Products) at 16%, 52DM at 12% (proprietary composition from Peach State Labs); TG472 (proprietary fluorochemical having PVC moieties from Daikin) at 0.5%.

C. (Inventive) 3 Step Treatment

Type 6,6 Nylon Academy carpet treated with RM (a proprietary composition from Peach State Labs) at 16%; 52DM at 12% and TG3361 (proprietary fluorochemical having PVC moieties from Daikin) at 0.5%

D. (Comparative) 1 Step Treatment

Type 6 Nylon Scholar carpet treated with DGF 30 at 16%, no topical treatment (per '758 patent)

E. (Inventive) 3 Step Treatment

Type 6,6 Nylon Scholar carpet treated with FX661 at 16%; 52DM at 12%; and TG3361 at 0.5%

F. (Inventive) 3 Step Treatment

Type 6,6 Nylon Scholar carpet RM at 16%; 52DM at 12%; and TG472 at 0.5%

Preparation of Comparative Examples A and D

In comparative examples A and D, a bath of DGF 30 to provide a 16% owf was prepared. The pH of the bath was adjusted to 1.55. DGF 30 is believed to have a % solids SAC of 30% (see '758 patent). Therefore, it is believed that the 16% owf DGF 30 solution provided an approximately 4.8% owf of dry SAC solids. The carpet sample was then subjected to a wet fixation step in accordance with the methods disclosed in the '758 patent. After this wet fixation step, the carpet sample was rinsed, extracted and dried, then allowed to condition at ambient conditions prior to being stained in accordance with the methods of Example 1.

Explanation of Results in FIG. 1

The continuous application method, with steam fixation, was used for Step 1 (the stainblocker application) and, when present, the exhaustible polymer was Step 2. The topical fluorochemical application was fixed using dry heat.

FIG. 1 shows that the inventive compositions provided improved Betadine resistance, as well as resistance to mustard and red wine, as compared to the results when the compositions and methods disclosed in the '758 patent were used. This improvement was seen with both type 6 nylon and type 6,6 nylon carpet samples. However, the improvement over the methods of the '758 patent were striking when the results are compared with nylon 6 fibers for all types of stainblockers (although the '758 patent addresses only SAC stainblocker materials). That is, the wet fix methods of the '758 patent provided improvement for all stain types for nylon 6,6 samples. However, when the '758 patent wet fix methods are used on nylon 6 samples, the Delta E CMC values for mustard and Betadine are large. When viewed, these stains were seen to be very prominent on the carpet samples and were judged as very stained and wholly unacceptable for use. Thus, it was found that the methods of the '758 patent did not provide resistance to staining by disperse dyes when the substrate was nylon 6 carpet samples.

It is not known why the '758 patent indicates that its methods provide resistance to staining by disperse dyes. That patent states that a modification of AATCC TM 175 is used, however, there is no disclosure of the scale used to gauge the results. That is, since Betadine and mustard resistance provide staining in different colors (i.e., yellow to brown) than the AATCC TM 175 red staining scale, to gauge the results of the '758 treatments, a scale specific to Betadine and mustard should have been prepared by the inventors therein. It is possible there was such a scale prepared, but the '758 patent does not disclose such a scale. Also, the '758 patent does not disclose details about the coloration or construction details of the carpet samples being treated which can be a significant factor when grading the degree of staining using visual methods. Nonetheless, in replicating the methods of the '758 patent, the inventor herein has determined according to an objective spectrophotometric measurement technique, that the methods of the '758 patent are, in the vast majority of cases studied, inferior to the methods of the present invention, especially when used on materials constructed with nylon 6 carpet samples.

Example 3

A series of experiments were conducted to assess Betadine stain resistance of Type 6 nylon acid dyeable samples and Type 6,6 cationic dyeable nylon carpet samples. Each inventive sample included a stainblocker, the type of which is noted in the table. For Tables C-F, an exhaustible polymer composition was also applied after the stainblocker step and prior to the topical treatment step. Following application of the topical treatment, the sample was treated in a dry fixation step as described above in Example 1. The type of topical treatment is noted in the Table. Further inventive examples included an exhaustible polymer composition treatment between the stainblocker and topical treatment steps as noted below.

The stainblocker materials tested were applied at 16% owf, based on the wet material, not drydown solids.

| Ingredients | % Solids (Measure) |
|---|---|
| TG3361 | 37.97 |
| TG 472 | 35.45 |
| Sitefil 90 | 31.03 |
| N201A | 31.27 |
| N119 | 32.01 |
| SR525 | 27.27 |
| FX661 | 28.64 |
| RM | 34.87 |
| WSFR | 23.61 |

CLM—Tannic acid powder

CRM—RM stainblocker and antioxidant

DGF 30—Mixture containing mainly SAC polymer

RM—high molecular weight, low OH-containing phenyl/phenol acrylic acid anionic polymer SF90—Sitefil 90—Ultralow molecular weight inner-penetrating polymer network co-reacted terpolymer containing dodecyl diphenyl oxide, methacrylic/acrylic acid anionic polymer.

50/50—a 50/50 mixture of DGF 30 (Simco Products) and Sitefil 90

LFS30F—polymer system with sulfoisophthalic acid moieties

N201A—SAC polymer

FX657—copolymer of methacrylic acid and a phenolic compound.

TG 472—fluoropolymer having vinyl chloride functionality in backbone

TG 3361—fluoropolymer having vinyl chloride functionality in backbone

When present, the exhaustible polymer treatments were as follows:

52 DM—multipolymer of styrene, acrylic acid and methacrylic acid, anionic character ECO—Modified cationic polyamine derivative.

Each exhaustible polymer composition was added to the exhaust bath to provide 12% owf of the wet material.

For each of Tables A-F, data in the table that is in italics is comparative and not within the bounds of the invention. In particular, all inventive examples require that the topical treatment be present. Further, all inventive samples involving light colored loop pile products require that the Delta E CMC value be 10 or less when using an unstained sample of the same sample as a reference for the color change due to the staining agent. In some aspects, the Delta E CMC value of an inventive example involving a light colored sample should be 6 or less. Also, since Ni 19 generally decreases the Betadine resistance of both nylon 6 and nylon 6,6, it is not considered to be part of the invention. As noted previously, since Ni 19 does not improve the stain resistance of the greige goods treated with either or both of the stainblocker and polymeric treatment, it is not a compatible topical treatment.

Stainblockers listed in bold type are believed to contain SAC stainblocker functionality.

TABLE A

Figure 2:
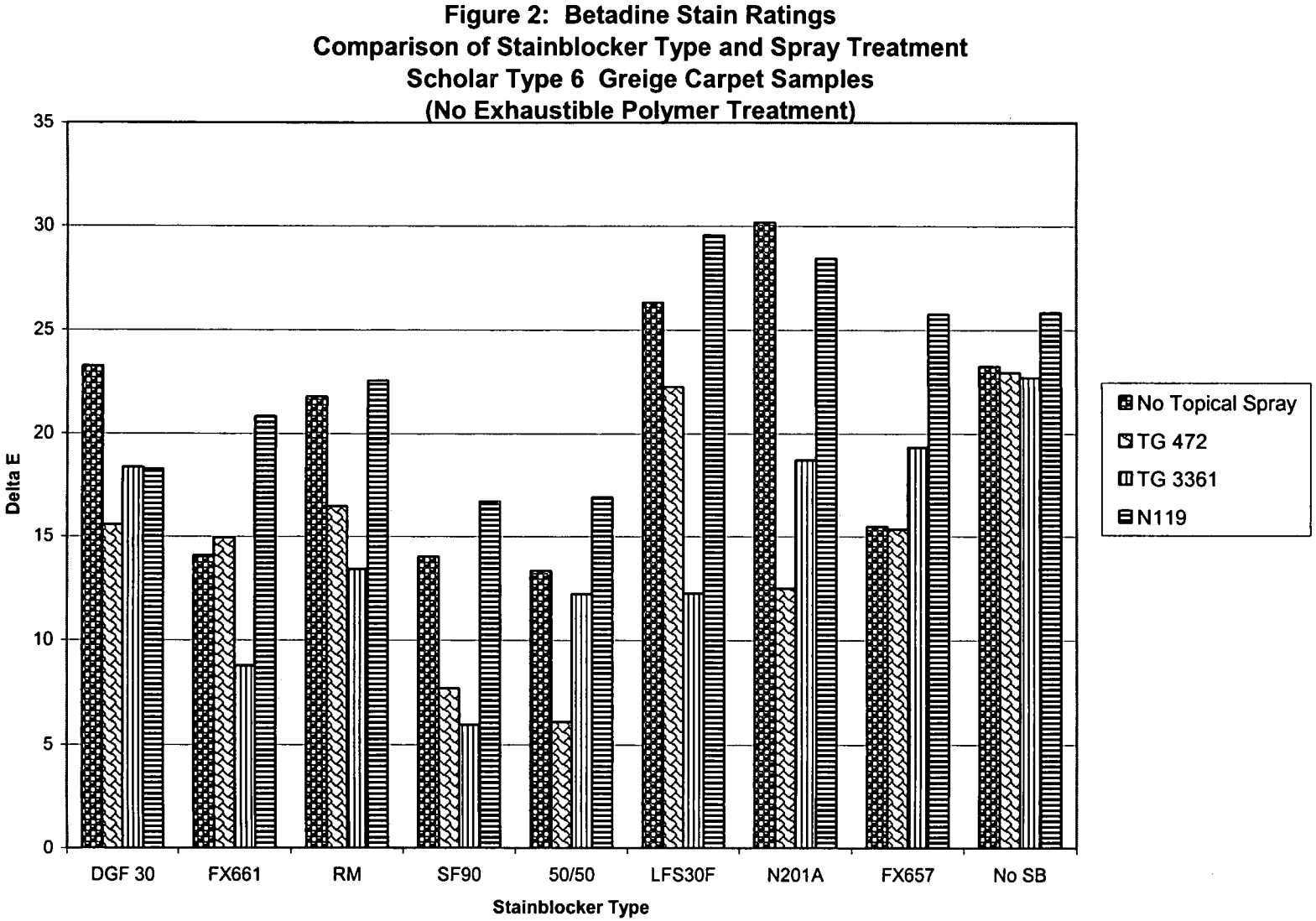
FIG. 2 shows a comparison of Betadine stain ratings (Delta E CMC) for different stainblocker types and topical treatment compositions for nylon 6 carpet samples. There are no exhaustible polymer treatments shown in this figure.

Academy Type 6, 6 Greige Good
Stainblocker only samples-no exhaustible
polymer treatment Data Graphed in FIG. 2

| Stainblocker | Topical treatment composition Type | | | |
|---|---|---|---|---|
| Type | None | TG 472 | TG 3361 | N119 |
| **DGF 30** | **4.22** | 1.04 | 2.16 | 4.63 |
| FX661 | 9.11 | 5.37 | 7.9 | 12.64 |
| **RM** | **6.78** | 2.58 | 1.85 | 7.67 |
| **SF90** | **17.31** | 2.92 | 7.88 | 19.95 |
| **50/50** | **7.72** | 5.63 | 3.39 | 6.92 |
| LFS30F | 20.51 | 12.71 | 8.18 | 17.58 |
| **N201A** | **2.69** | 1.99 | 2.97 | 2.79 |
| FX657 | 16.7 | 12.15 | 7.03 | 16.82 |
| No SB | 19.3 | 21.55 | 20.5 | 20.19 |

For nylon 6,6, Table A shows that the topical treatment compositions are believed to have PVC moieties in the polymer backbone improve the Betadine resistance of the stainblocker treatments alone. N 119 does not provide any improvement and is therefore not compatible with this combination. In all cases where a stainblocker is present, the PVC-containing polymer topical treatments improve the Betadine stain resistance over the stainblocker alone.

TABLE B

Figure 3:
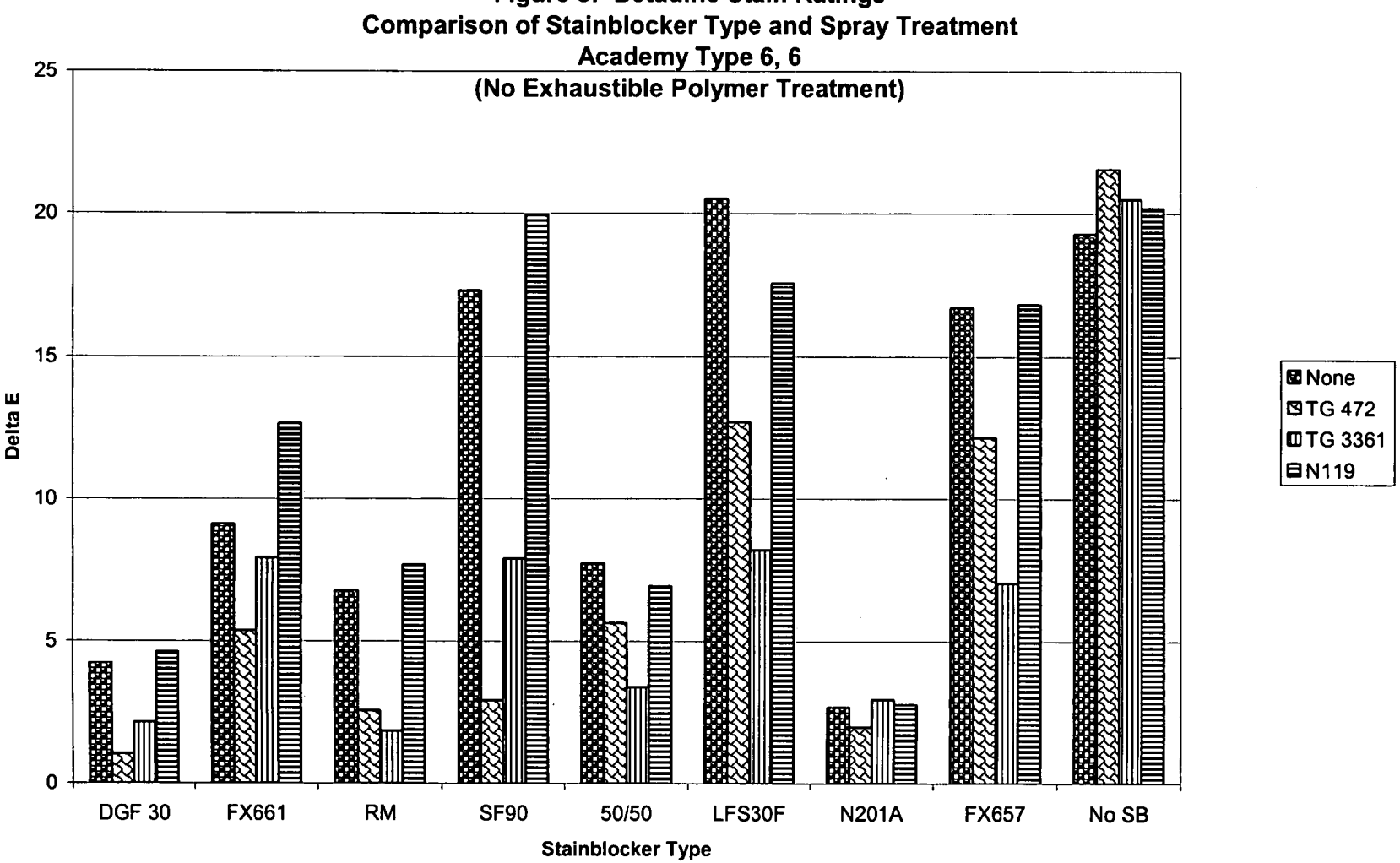
FIG. 3 shows a comparison of Betadine stain ratings (Delta E CMC) for different stainblocker types and topical treatment compositions for nylon 6,6 carpet samples. There are no exhaustible polymer treatments with this figure.

Academy Type 6, 6
Stainblocker with 52 DM exhaustible polymer
treatment 12% OWF Data Graphed in FIG. 3

| Stainblocker Type | Topical treatment composition Type | | | |
|---|---|---|---|---|
| | No Topical Spray | TG 472 | TG 3361 | N119 |
| **DGF 30** | 3.34 | 0.56 | 1.89 | 5.78 |
| FX661 | 6.04 | 1.8 | 2.41 | 8.93 |
| **RM** | 5.01 | 2.17 | 2.01 | 5.78 |
| **SF90** | 12.04 | 3.28 | 3.41 | 14.58 |
| **50/50** | 8.42 | 2.45 | 1.99 | 5.02 |
| LFS30F | 15.19 | 2.81 | 6.21 | 13.98 |
| **N201A** | 2.85 | 1.49 | 2.16 | 2.66 |
| FX657 | 12.7 | 7.63 | 6.95 | 17.83 |

For nylon 6,6, Table B shows that the PVC containing polymers in the topical treatment compositions improve the Betadine stain resistance of the greige good when 52 DM is the exhaustible polymer treatment. Comparing this data to Table A, the exhaustible polymer treatment improves the Betadine stain resistance. All stainblocker-52 DM exhaustible polymer composition combinations provide excellent to acceptable Betadine resistance when the PVC-containing polymer topical treatment compositions are used.

TABLE C

Figure 4:
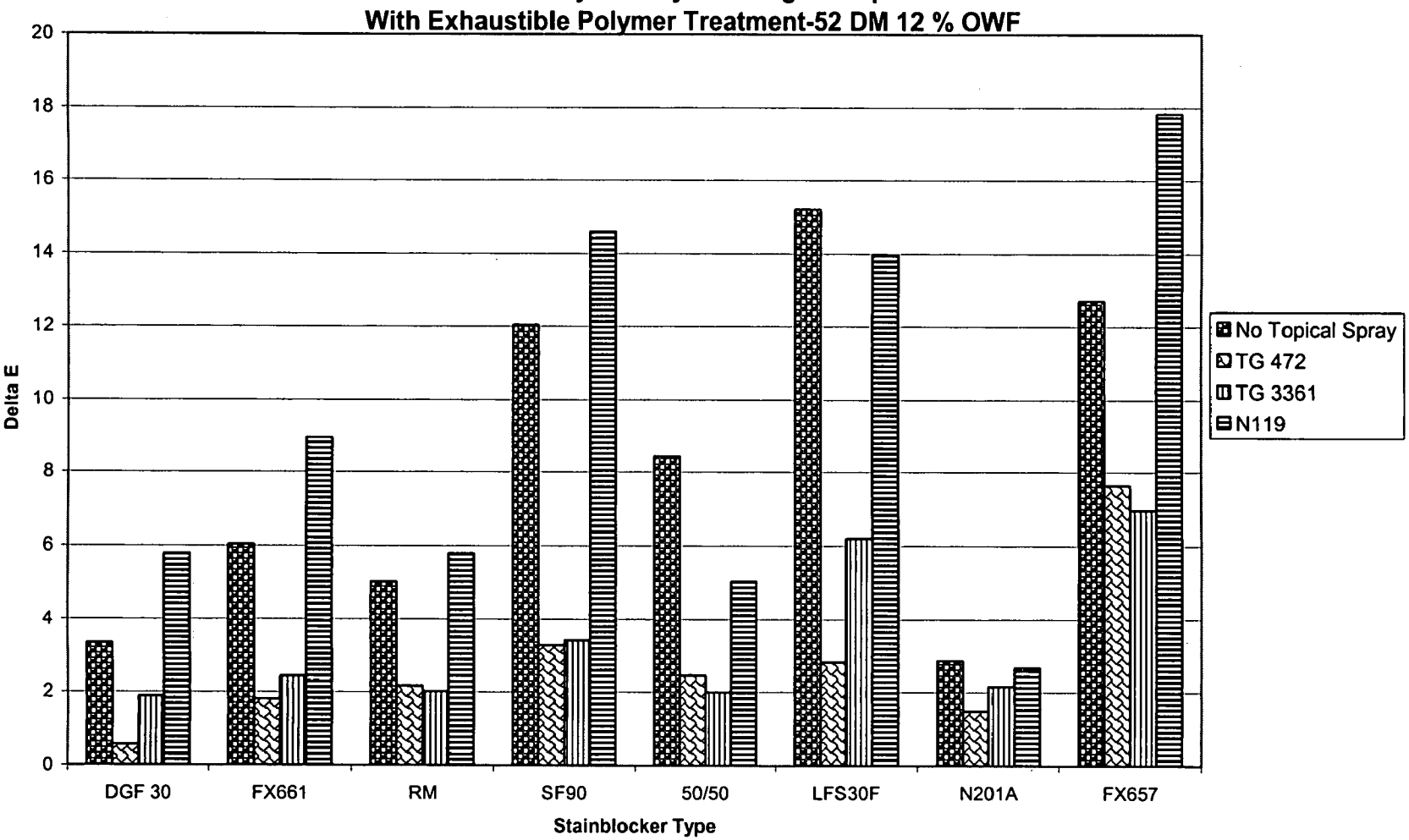
FIG. 4 shows a comparison of Betadine stain ratings (Delta E CMC) for different stainblocker types and topical treatment compositions for nylon 6,6 carpet samples. These samples each have exhaustible polymer treatment of 52 DM 12% OWF.

Academy Type 6, 6
Stainblocker with ECO exhaustible polymer
treatment 12% OWF Data Graphed in FIG. 4

| Stainblocker | Topical Spray Treatment Type | | | |
|---|---|---|---|---|
| Type | No Topical Spray | TG 472 | TG 3361 | N119 |
| **DGF 30** | 6.27 | 3.28 | 2.86 | 7.49 |
| FX661 | 21.3 | 16.8 | 17.78 | 18.41 |

TABLE C-continued

| Academy Type 6, 6 Stainblocker with ECO exhaustible polymer treatment 12% OWF Data Graphed in FIG. 4 | | | | |
|---|---|---|---|---|
| Stainblocker | Topical Spray Treatment Type | | | |
| Type | No Topical Spray | TG 472 | TG 3361 | N119 |
| **RM** | 9.12 | 8.73 | 6.03 | 6.82 |
| **SF90** | 20.62 | 9.36 | 9.44 | 19.69 |
| **50/50** | 14.38 | 10.15 | 7.1 | 13.88 |
| LFS30F | 21.86 | 7.17 | 5.29 | 16.7 |
| **N201A** | 4.17 | 0.6 | 0.72 | 3.6 |
| FX657 | 15.85 | 11.5 | 6.09 | 20.47 |

Table C demonstrates that N201A provides superior Betadine resistance with application of TG 472 and TG 3361 as topical spray treatments when ECO is used as the exhaustible polymer composition.

TABLE D

| Scholar Type 6 Greige Good Stainblocker only samples-no exhaustible polymer treatment Data Graphed in FIG. 5 | | | | |
|---|---|---|---|---|
| | Topical treatment composition Type | | | |
| Stainblocker Type | No Topical Spary | TG 472 | TG 3361 | N119 |
| **DGF 30** | **23.25** | 15.57 | 18.37 | 18.28 |
| FX661 | 14.07 | 14.94 | 8.8 | 20.81 |
| **RM** | **21.76** | 16.45 | 13.41 | 22.55 |
| **SF90** | **14.01** | 7.7 | 5.97 | 16.68 |
| **50/50** | **13.32** | 6.09 | 12.22 | 16.9 |
| LFS30F | 26.33 | 22.25 | 12.25 | 29.55 |
| **N201A** | **30.18** | 12.48 | 18.71 | 28.46 |
| FX657 | 15.49 | 15.35 | 19.34 | 25.78 |
| No SB | 23.24 | 22.95 | 22.72 | 25.86 |

Table D demonstrates that SF 90 (Sitefil 90) and 50/50 SF 90 and DGF 30 provide acceptable Betadine resistance when used with TG 472. TG 3361 provides acceptable to marginal Betadine resistance when used with SF 90 and FX 661. Nonetheless, without the exhaustible polymer treatment, excellent Betadine resistance is not seen for any stain

TABLE E

| Scholar Type 6 Stainblocker with 52 DM exhaustible polymer treatment 12% OWF Data Graphed in FIG. 6 | | | | |
|---|---|---|---|---|
| | Topical treatment composition Type | | | |
| Stainblocker Type | No Topical Spray | TG 472 | TG 3361 | N119 |
| **DGF 30** | 14.39 | 4.41 | 7.19 | 18.06 |
| FX661 | 13.82 | 5.68 | 3.2 | 19.18 |
| **RM** | 9.47 | 6.58 | 7.28 | 17.97 |
| **SF90** | 9.16 | 3.7 | 3.1 | 9.63 |
| **50/50** | 8.7 | 5.14 | 4.57 | 8.9 |
| LFS30F | 18.34 | 8.12 | 8.4 | 21.74 |
| **N201A** | 20.41 | 4.53 | 2.75 | 26.57 |
| FX657 | 10.89 | 7.88 | 7.19 | 19.54 |

Table E shows that 52 DM provides acceptable to excellent Betadine stain resistance values on nylon 6 loop pile construction with all stainblockers tested and TG 472 and TG 3361 as the topical spray composition. N119 provides marginally acceptable values with SF 90 (Sitefil 90) and 50/50 SF 90 and DGF 30, however, these values are not better than without any topical spray, thus indicating that N119 does not provide any significant benefits.

TABLE F

| Scholar Type 6 Stainblocker with ECO exhaustible polymer treatment 12% OWF Data Graphed in FIG. 7 | | | | |
|---|---|---|---|---|
| | Topical treatment composition Type | | | |
| Stainblocker Type | No Topical Spray | TG 472 | TG 3361 | N 119 |
| **DGF 30** | 21.94 | 18.69 | 8.57 | 22.09 |
| FX661 | 24.32 | 10.84 | 17.33 | 26.03 |
| **RM** | 14.92 | 11.92 | 2.26 | 15.27 |
| **SF90** | 15.88 | 15.74 | 12.69 | 16.54 |
| **50/50** | 14.37 | 12.16 | 12.53 | 13.9 |
| LFS30F | 25.66 | 17.19 | 18.67 | 31.28 |
| **N201A** | 29.2 | 15.15 | 12.66 | 30.3 |
| FX657 | 22.54 | 20.57 | 14 | 25.65 |

Table F indicates that only DGF 30 and RM with TG 3361 as the topical spray composition provide acceptable Betadine stain resistance values when used with ECO exhaustible polymer composition on nylon type 6 greige good.

Example 4

The fiber type in these examples is Solutia Type 1993 Superba set staple yarn in a dense cut-pile construction.

Stain resist materials in bold are believed to contain SAC polymers.

Stain resist is applied using a continuous simulation at 400% wpu, pH, steam fixed.

Second step polymer, where applied is 52DM-12% application pH 1.55, continuous simulation steam fixed.

Fluorochemical, where applied is TG 3361-0.5%, spray applied, dry fixed The "SB Only" columns represent the invention described in U.S. Pat. No. 6,814,758, consisting essentially of a single step wet fix application of SAC at a level at or above 2.0% dry SAC polymer on fiber by weight.

The "SB and Polymer and FC" represents yet another aspect of the present invention the inventive examples, comprising a continuous stimulation stainblocker application with wet fixation, followed by a exhaustible polymer application with wet fixation, and then followed by a topical treatment composition including a fluoropolymer with dry fixation.

The second column, labeled 2 Step, is an application of stainblocker, followed by application of the topical fluorochemicals as outlined in one aspect of the present invention. No exhaustible polymer application was conducted in such 2 Step methods.

Xenon Lightfastness Ratings
AATCC Test Method 16 (incorporated herein by reference)

| Stain Resist | Xenon 40 hr | | |
|---|---|---|---|
| | 1 step SB only | 2 step SB and Topical treatment | 3 Step SB and Polymer and topical treatment |
| **N201A-18%** | 10.07 | 9.56 | 4.04 |
| LFS30F-25% | 3.02 | 3.07 | 2.86 |
| **CRM-25%** | 2.93 | 2.72 | 1.68 |
| Untreated | 3.5 | | |

Mustard Resistance
Measured using test method of Example 1
Values reported are Delta E CMC

| | Mustard 24 hr | | |
|---|---|---|---|
| | 1 Step SB Only | 2 Step SB and Topical treatment | 3 Step SB and polymer and topical treatment |
| **N201A-18%** | 1.95 | 4.99 | 5.13 |
| LFS30F-25% | 9.61 | 5.32 | 25.71 |
| **CRM-25%** | 8.28 | 2.81 | 3.96 |
| Untreated | 40.45 | | |

Red Wine Resistance
Measured using test method of Example 1
Values reported are Delta E CMC values representing the amount of staining

| | Red wine 24 hr | | |
|---|---|---|---|
| | SB Only | SB and Topical treatment | SB and Polymer and topical treatment |
| **N201A-18%** | 13.77 | 4.48 | 8.49 |
| LFS30F-25% | 3.77 | 3.33 | 3 |
| **CRM-25%** | 9 | 3.25 | 1.93 |
| Untreated | 8.8 | | |

Betadine Resistance
Measured using test method of Example 1
Values reported are Delta E CMC ratings

| | Betadine 24 hr | | |
|---|---|---|---|
| | SB Only | SB and Topical treatment | SB and polymer and topical treatment |
| **N201A-18%** | 40.94 | 36.79 | 19.24 |
| LFS30F-25% | 70.51 | 60.03 | 46.11 |
| **CRM-25%** | 43.42 | 36.79 | 36.52 |
| Untreated | 76.22 | | |

Example 5

Key to Tables 5A-5D

SB: Stainblocker type/amount (% owf based on wet material to dry fiber)

Pol: Exhaustible polymer composition type/amount (% owf based on wet material to dry fiber)

Topical FC: Topical treatment type/amount (% owf based on wet material to dry fiber) (fluorochemical)

Heating Type: Wet fix treatment type
Cont: Continuous Processing
Exh: Exhaust bath Xenon 40 hr: AATCC 16 Xenon Lightfastness Test Red Wine: Modification of AATCC TM 175 test as described in Example 1

Mustard: Modification of AATCC TM 175 test as described in Example 1

Betadine: Modification of AATCC TM 175 test as described in Example 1

DE: Delta E CMC measurement as described in Example 1. Lower Delta E CMC means better results (that is, less staining).

*: Comparative example (that is, no topical treatment step).

TABLE 5A

Scholar Type 6 Greige Good
Comparison of Treatment Types

| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| * 12/18-2-1 | Bath 1 SB | N201A-16% | 400 | 4.5 | Cont | 210 | 5 | 3.27 | 2.91 | 20.97 | 16.5 |
| | Bath 2 Pol | none | | | | | | | | | |
| | Topical FC | none | | | | | | | | | |
| * 12/18-2-2 | Bath 1 SB | LFS30-16%, CLM-1% | 400 | 1.6 | Cont | 210 | 5 | 2.43 | 1.9 | 7.59 | 10.59 |
| | Bath 2 Pol | none | | | | | | | | | |
| | Topical FC | none | | | | | | | | | |
| * 12/18-2-3 | Bath 1 SB | FX661-16% | 400 | 1.6 | Cont | 210 | 5 | 1.56 | 1.87 | 8.66 | 10.48 |
| | Bath 2 Pol | none | | | | | | | | | |
| | Topical FC | none | | | | | | | | | |
| * 12/18-2-4 | Bath 1 SB | RM-16% | 400 | 1.6 | Cont | 210 | 5 | 2.78 | 8.23 | 13.69 | 9.74 |
| | Bath 2 Pol | none | | | | | | | | | |
| | Topical FC | none | | | | | | | | | |
| * 12/18-2-5 | Bath 1 SB | N201A-16% | 2200 | 4.5 | Exh | 180 | 20 | 3.25 | 1.9 | 5.65 | 3.55 |
| | Bath 2 Pol | none | | | | | | | | | |
| | Topical FC | none | | | | | | | | | |
| * 12/18-2-6 | Bath 1 SB | LFS30-16%, CLM-1% | 2200 | 2.2 | Exh | 180 | 20 | 2.64 | 1.68 | 3.06 | 3.72 |
| | Bath 2 Pol | none | | | | | | | | | |
| | Topical FC | none | | | | | | | | | |
| * 12/18-2-7 | Bath 1 SB | FX661-16% | 2200 | 2.2 | Exh | 180 | 20 | 0.73 | 1.31 | 4.77 | 4.07 |
| | Bath 2 Pol | none | | | | | | | | | |
| | Topical FC | none | | | | | | | | | |
| * 12/18-2-8 | Bath 1 SB | RM-16% | 2200 | 2.2 | Exh | 180 | 20 | 1.8 | 5.17 | 5.29 | 2.61 |
| | Bath 2 Pol | none | | | | | | | | | |
| | Topical FC | none | | | | | | | | | |
| 12/18-2-9 | Bath 1 SB | N201A-16% | 400 | 4.5 | Cont | 210 | 5 | 2.28 | 1.75 | 9.86 | 6.09 |
| | Bath 2 Pol | none | | | | | | | | | |
| | Topical FC | TG3361-0.5% | 40 | | Dry | 230 | 5 | | | | |
| 12/18-2-10 | Bath 1 SB | LFS30-16%, CLM-1% | 400 | 1.6 | Cont | 210 | 5 | 1.89 | 1.47 | 5.24 | 4.96 |
| | Bath 2 Pol | none | | | | | | | | | |
| | Topical FC | TG3361-0.5% | 40 | | Dry | 230 | 5 | | | | |
| 12/18-2-11 | Bath 1 SB | FX661-16% | 400 | 1.6 | Cont | 210 | 5 | 1.2 | 1.18 | 4.09 | 3.31 |
| | Bath 2 Pol | none | | | | | | | | | |
| | Topical FC | TG3361-0.5% | 40 | | Dry | 230 | 5 | | | | |
| 12/18-2-12 | Bath 1 SB | RM-16% | 400 | 1.6 | Cont | 210 | 5 | 2.08 | 1.35 | 4.68 | 3.76 |
| | Bath 2 Pol | none | | | | | | | | | |
| | Topical FC | TG3361-0.5% | 40 | | Dry | 230 | 5 | | | | |
| 12/18-2-13 | Bath 1 SB | N201A-16% | 2200 | 4.5 | Exh | 180 | 20 | 2.62 | 1.17 | 1.59 | 2.91 |
| | Bath 2 Pol | none | | | | | | | | | |
| | Topical FC | TG3361-0.5% | 40 | | Dry | 230 | 5 | | | | |
| 12/18-2-14 | Bath 1 SB | LFS30-16%, CLM-1% | 2200 | 2.2 | Exh | 180 | 20 | 2.76 | 0.91 | 2.47 | 3.34 |
| | Bath 2 Pol | none | | | | | | | | | |
| | Topical FC | TG3361-0.5% | 40 | | Dry | 230 | 5 | | | | |
| 12/18-2-15 | Bath 1 SB | FX661-16% | 2200 | 2.2 | Exh | 180 | 20 | 1.04 | 1.49 | 2.13 | 2.21 |
| | Bath 2 Pol | none | | | | | | | | | |
| | Topical FC | TG3361-0.5% | 40 | | Dry | 230 | 5 | | | | |
| 12/18-2-16 | Bath 1 SB | RM-16% | 2200 | 2.2 | Exh | 180 | 20 | 1.92 | 1.64 | 1.46 | 1.38 |
| | Bath 2 Pol | none | | | | | | | | | |

TABLE 5A-continued

Scholar Type 6 Greige Good
Comparison of Treatment Types

| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| | Topical FC | TG3361-0.5% | 40 | | Dry | 230 | 5 | | | | |
| 12/18-2-17 | Bath 1 SB | N201A-16% | 400 | 4.5 | Cont | 210 | 5 | 0.72 | 1.46 | 4.26 | 2.68 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-18 | Bath 1 SB | LFS30-16%, CLM-1% | 400 | 1.6 | Cont | 210 | 5 | 2.02 | 1.68 | 2.71 | 2.02 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-19 | Bath 1 SB | FX661-16% | 400 | 1.6 | Cont | 210 | 5 | 1.63 | 1.85 | 3.55 | 3.41 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-20 | Bath 1 SB | RM-16% | 400 | 1.6 | Cont | 210 | 5 | 1.42 | 1.49 | 2.91 | 4.68 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-21 | Bath 1 SB | N201A-16% | 2200 | 4.5 | Exh | 180 | 20 | 1.07 | 1.66 | 2.26 | 3.44 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-22 | Bath 1 SB | LFS30-16%, CLM-1% | 2200 | 2.2 | Exh | 180 | 20 | 1.62 | 1.74 | 2.46 | 3.26 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-23 | Bath 1 SB | FX661-16% | 2200 | 2.2 | Exh | 180 | 20 | 2.44 | 1.38 | 2.84 | 3.39 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-24 | Bath 1 SB | RM-16% | 2200 | 2.2 | Exh | 180 | 20 | 1.59 | 2.84 | 2.48 | 2.42 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-2-25 | Bath 1 SB | N201A-16% | 400 | 4.5 | Cont | 210 | 5 | 2.26 | 0.64 | 8.2 | 13.26 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-26 | Bath 1 SB | LFS30-16%, CLM-1% | 400 | 1.6 | Cont | 210 | 5 | 0.74 | 1.98 | 6.84 | 12.86 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-27 | Bath 1 SB | FX661-16% | 400 | 1.6 | Cont | 210 | 5 | 1.07 | 0.73 | 8.74 | 6.02 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-28 | Bath 1 SB | RM-16% | 400 | 1.6 | Cont | 210 | 5 | 1.73 | 0.52 | 9.25 | 7.75 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-29 | Bath 1 SB | N201A-16% | 2200 | 4.5 | Exh | 180 | 20 | 2.23 | 1.06 | 4.51 | 9.35 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-30 | Bath 1 SB | LFS30-16%, CLM-1% | 2200 | 2.2 | Exh | 180 | 20 | 1.61 | 1.59 | 4.88 | 4.95 |
| | Bath 2 Pol | ECO-12% | 400 | 4 | Cont | 210 | 2 | | | | |

TABLE 5A-continued

| Scholar Type 6 Greige Good Comparison of Treatment Types | | | | | | | | | | | |
|---|---|---|---|---|---|---|---|---|---|---|---|
| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
| | Topical FC | TG3361-0.5% | 40 | | Dry | 230 | 5 | | | | |
| 12/18-2-31 | Bath 1 SB | FX661-16% | 2200 | 2.2 | Exh | 180 | 20 | 0.68 | 1.77 | 4.21 | 4.97 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-32 | Bath 1 SB | RM-16% | 2200 | 2.2 | Exh | 180 | 20 | 1.76 | 0.45 | 2.53 | 4.77 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-2-33 | Bath 1 SB | none | | | | | | 0.69 | 1.29 | 27.57 | 20.91 |
| | Bath 2 Pol | none | | | | | | | | | |
| | Topical FC | none | | | | | | | | | |

The above data shows that the present invention is suitable for use on a nylon 6 material. Further, an unexpected finding is that for all types of stain treatments (including the comparative examples) a better disperse dye stain resistance is seen with exhaust application methods. Without being bound by theory, it is believed that with an exhaust treatment, more energy is available to provide deposition of the stainblocker and/or exhaustible polymer onto the fiber. It is further believed that a lesser amount of energy is available in a continuous process. Since a continuous process is the more economical and more commonly used application method for commercial products, this finding is significant.

TABLE 5B

| Academy Type 6,6 Nylon Greige Good | | | | | | | | | | | |
|---|---|---|---|---|---|---|---|---|---|---|---|
| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
| * 12/18-1-1 | Bath 1 SB | N201A-16% | 400 | 4.5 | Cont | 210 | 5 | 1.74 | 2.39 | 2.8 | 5.05 |
| | Bath 2 Pol | none | | | | | | | | | |
| | Topical FC | none | | | | | | | | | |
| * 12/18-1-2 | Bath 1 SB | LFS30-16%, CLM-1% | 400 | 1.6 | Cont | 210 | 5 | 0.6 | 1.37 | 5.55 | 16.87 |
| | Bath 2 Pol | none | | | | | | | | | |
| | Topical FC | none | | | | | | | | | |
| * 12/18-1-3 | Bath 1 SB | FX661-16% | 400 | 1.6 | Cont | 210 | 5 | 0.18 | 1.52 | 3.55 | 14.51 |
| | Bath 2 Pol | none | | | | | | | | | |
| | Topical FC | none | | | | | | | | | |
| * 12/18-1-4 | Bath 1 SB | RM-16% | 400 | 1.6 | Cont | 210 | 5 | 0.65 | 5.02 | 3.72 | 6.88 |
| | Bath 2 Pol | none | | | | | | | | | |
| | Topical FC | none | | | | | | | | | |
| * 12/18-1-5 | Bath 1 SB | N201A-16% | 2200 | 4.5 | Exh | 180 | 20 | 1.74 | 4.36 | 1.95 | 3.41 |
| | Bath 2 Pol | none | | | | | | | | | |
| | Topical FC | none | | | | | | | | | |
| * 12/18-1-6 | Bath 1 SB | LFS30-16%, CLM-1% | 2200 | 2.2 | Exh | 180 | 20 | 1.89 | 1.76 | 3.13 | 7.76 |
| | Bath 2 Pol | none | | | | | | | | | |
| | Topical FC | none | | | | | | | | | |
| * 12/18-1-7 | Bath 1 SB | FX661-16% | 2200 | 2.2 | Exh | 180 | 20 | 0.56 | 0.67 | 5.04 | 18.52 |
| | Bath 2 Pol | none | | | | | | | | | |
| | Topical FC | none | | | | | | | | | |

TABLE 5B-continued

| Academy Type 6,6 Nylon Greige Good | | | | | | | | | | | |
|---|---|---|---|---|---|---|---|---|---|---|---|
| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
| * 12/18-1-8 | Bath 1 SB | RM-16% | 2200 | 2.2 | Exh | 180 | 20 | 0.54 | 2.68 | 2.06 | 4.58 |
| | Bath 2 Pol | none | | | | | | | | | |
| | Topical FC | none | | | | | | | | | |
| 12/18-1-9 | Bath 1 SB | N201A-16% | 400 | 4.5 | Cont | 210 | 5 | 1.43 | 0.95 | 1.77 | 2.95 |
| | Bath 2 Pol | none | | | | | | | | | |
| | Topical FC | TG3361-0.5% | 40 | | Dry | 230 | 5 | | | | |
| 12/18-1-10 | Bath 1 SB | LFS30-16%, CLM-1% | 400 | 1.6 | Cont | 210 | 5 | 0.41 | 1.1 | 1.79 | 6.02 |
| | Bath 2 Pol | none | | | | | | | | | |
| | Topical FC | TG3361-0.5% | 40 | | Dry | 230 | 5 | | | | |
| 12/18-1-11 | Bath 1 SB | FX661-16% | 400 | 1.6 | Cont | 210 | 5 | 0.48 | 1.44 | 3.94 | 4.99 |
| | Bath 2 Pol | none | | | | | | | | | |
| | Topical FC | TG3361-0.5% | 40 | | Dry | 230 | 5 | | | | |
| 12/18-1-12 | Bath 1 SB | RM-16% | 400 | 1.6 | Cont | 210 | 5 | 0.52 | 0.93 | 2.37 | 3.08 |
| | Bath 2 Pol | none | | | | | | | | | |
| | Topical FC | TG3361-0.5% | 40 | | Dry | 230 | 5 | | | | |
| 12/18-1-13 | Bath 1 SB | N201A-16% | 2200 | 4.5 | Exh | 180 | 20 | 1.96 | 1.17 | 1.32 | 1.59 |
| | Bath 2 Pol | none | | | | | | | | | |
| | Topical FC | TG3361-0.5% | 40 | | Dry | 230 | 5 | | | | |
| 12/18-1-14 | Bath 1 SB | LFS30-16%, CLM-1% | 2200 | 2.2 | Exh | 180 | 20 | 1.78 | 1.82 | 2.33 | 3.65 |
| | Bath 2 Pol | none | | | | | | | | | |
| | Topical FC | TG3361-0.5% | 40 | | Dry | 230 | 5 | | | | |
| 12/18-1-15 | Bath 1 SB | FX661-16% | 2200 | 2.2 | Exh | 180 | 20 | 0.58 | 1.6 | 5.23 | 13.92 |
| | Bath 2 Pol | none | | | | | | | | | |
| | Topical FC | TG3361-0.5% | 40 | | Dry | 230 | 5 | | | | |
| 12/18-1-16 | Bath 1 SB | RM-16% | 2200 | 2.2 | Exh | 180 | 20 | 0.75 | 0.64 | 1.95 | 2.12 |
| | Bath 2 Pol | none | | | | | | | | | |
| | Topical FC | TG3361-0.5% | 40 | | Dry | 230 | 5 | | | | |
| 12/18-1-17 | Bath 1 SB | N201A-16% | 400 | 4.5 | Cont | 210 | 5 | 0.9 | 0.75 | 1.87 | 4.43 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-18 | Bath 1 SB | LFS30-16%, CLM-1% | 400 | 1.6 | Cont | 210 | 5 | 0.68 | 0.68 | 4.16 | 7.07 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-19 | Bath 1 SB | FX661-16% | 400 | 1.6 | Cont | 210 | 5 | 0.35 | 0.76 | 1.71 | 5.81 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-20 | Bath 1 SB | RM-16% | 400 | 1.6 | Cont | 210 | 5 | 0.81 | 0.58 | 1.36 | 3.74 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-21 | Bath 1 SB | N201A-16% | 2200 | 4.5 | Exh | 180 | 20 | 0.91 | 0.89 | 2.78 | 2.85 |
| | Bath 2 Pol | 52DM-12% | 400 | 1.55 | Cont | 210 | 2 | | | | |
| | Topical FC | TG3361-0.5% | 40 | | Dry | 230 | 5 | | | | |

TABLE 5B-continued

| Academy Type 6,6 Nylon Greige Good | | | | | | | | | | | |
|---|---|---|---|---|---|---|---|---|---|---|---|
| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
| 12/18-1-22 | Bath 1 SB | LFS30-16%, CLM-1% | 2200 | 2.2 | Exh | 180 | 20 | 1.45 | 1.38 | 3.36 | 5.54 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-23 | Bath 1 SB | FX661-16% | 2200 | 2.2 | Exh | 180 | 20 | 0.61 | 0.56 | 1.14 | 6.79 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-24 | Bath 1 SB | RM-16% | 2200 | 2.2 | Exh | 180 | 20 | 0.56 | 0.42 | 2.44 | 5.33 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-1-25 | Bath 1 SB | N201A-16% | 400 | 4.5 | Cont | 210 | 5 | 1.62 | 1.08 | 1.79 | 3.08 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-26 | Bath 1 SB | LFS30-16%, CLM-1% | 400 | 1.6 | Cont | 210 | 5 | 1.03 | 1.72 | 4.51 | 7.58 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-27 | Bath 1 SB | FX661-16% | 400 | 1.6 | Cont | 210 | 5 | 0.61 | 2.32 | 6.26 | 6.08 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-28 | Bath 1 SB | RM-16% | 400 | 1.6 | Cont | 210 | 5 | 0.75 | 1.17 | 2.2 | 2.39 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-29 | Bath 1 SB | N201A-16% | 2200 | 4.5 | Exh | 180 | 20 | 1.54 | 0.47 | 2.5 | 1.18 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-30 | Bath 1 SB | LFS30-16%, CLM-1% | 2200 | 2.2 | Exh | 180 | 20 | 1.6 | 1.88 | 5.14 | 10.69 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-31 | Bath 1 SB | FX661-16% | 2200 | 2.2 | Exh | 180 | 20 | 0.77 | 0.99 | 8.67 | 8.02 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-32 | Bath 1 SB | RM-16% | 2200 | 2.2 | Exh | 180 | 20 | 0.69 | 0.45 | 1.24 | 3.22 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-1-33 | Bath 1 SB | none | | | | | | 0.37 | 2.56 | 22.76 | 19.01 |
| | Bath 2 Pol | none | | | | | | | | | |
| | Topical FC | none | | | | | | | | | |

The above table demonstrates that although the baseline staining of Academy is less because it is a nylon 6,6 carpet sample, the present invention improves the stain resistance ratings over the values of treatments without the topical treatment. With nylon 6,6 greige good, it is not always necessary to use the exhaustible polymer treatment to obtain acceptable stain resistance.

TABLE 5C

2099 Type 6, 6 Superba set cut-pile construction

| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| * 12/18-5-1 | Bath 1 SB | N201A-16% | 400 | 4.5 | Cont | 210 | 5 | 9.82 | 8.05 | 8.66 | 39.11 |
| | Bath 2 Pol | none | | | | | | | | | |
| | Topical FC | none | | | | | | | | | |
| * 12/18-5-2 | Bath 1 SB | LFS30-16%, CLM-1% | 400 | 1.6 | Cont | 210 | 5 | 2.36 | 5.66 | 33.38 | 55.3 |
| | Bath 2 Pol | none | | | | | | | | | |
| | Topical FC | none | | | | | | | | | |
| * 12/18-5-3 | Bath 1 SB | FX661-16% | 400 | 1.6 | Cont | 210 | 5 | 4.87 | 2.89 | 35.04 | 62.6 |
| | Bath 2 Pol | none | | | | | | | | | |
| | Topical FC | none | | | | | | | | | |
| * 12/18-5-4 | Bath 1 SB | RM-16% | 400 | 1.6 | Cont | 210 | 5 | 3.29 | 8.55 | 11.03 | 48 |
| | Bath 2 Pol | none | | | | | | | | | |
| | Topical FC | none | | | | | | | | | |
| * 12/18-5-5 | Bath 1 SB | N201A-16% | 2200 | 4.5 | Exh | 180 | 20 | 5.5 | 7.4 | 10.07 | 54.51 |
| | Bath 2 Pol | none | | | | | | | | | |
| | Topical FC | none | | | | | | | | | |
| * 12/18-5-6 | Bath 1 SB | LFS30-16%, CLM-1% | 2200 | 2.2 | Exh | 180 | 20 | 1.45 | 3.95 | 25.8 | 61.48 |
| | Bath 2 Pol | none | | | | | | | | | |
| | Topical FC | none | | | | | | | | | |
| * 12/18-5-7 | Bath 1 SB | FX661-16% | 2200 | 2.2 | Exh | 180 | 20 | 4.57 | 3.54 | 29.38 | 64.38 |
| | Bath 2 Pol | none | | | | | | | | | |
| | Topical FC | none | | | | | | | | | |
| * 12/18-5-8 | Bath 1 SB | RM-16% | 2200 | 2.2 | Exh | 180 | 20 | 1.9 | 5.99 | 21.66 | 60.04 |
| | Bath 2 Pol | none | | | | | | | | | |
| | Topical FC | none | | | | | | | | | |
| 12/18-5-9 | Bath 1 SB | N201A-16% | 400 | 4.5 | Cont | 210 | 5 | 8.51 | 2.62 | 10.49 | 22.5 |
| | Bath 2 Pol | none | | | | | | | | | |
| | Topical FC | TG3361-0.5% | 40 | | Dry | 230 | 5 | | | | |
| 12/18-5-10 | Bath 1 SB | LFS30-16%, CLM-1% | 400 | 1.6 | Cont | 210 | 5 | 1.18 | 4.33 | 12.51 | 39.56 |
| | Bath 2 Pol | none | | | | | | | | | |
| | Topical FC | TG3361-0.5% | 40 | | Dry | 230 | 5 | | | | |
| 12/18-5-11 | Bath 1 SB | FX661-16% | 400 | 1.6 | Cont | 210 | 5 | 4.44 | 2.15 | 22.95 | 53.77 |
| | Bath 2 Pol | none | | | | | | | | | |
| | Topical FC | TG3361-0.5% | 40 | | Dry | 230 | 5 | | | | |
| 12/18-5-12 | Bath 1 SB | RM-16% | 400 | 1.6 | Cont | 210 | 5 | 2.96 | 1.45 | 23.75 | 45.34 |
| | Bath 2 Pol | none | | | | | | | | | |
| | Topical FC | TG3361-0.5% | 40 | | Dry | 230 | 5 | | | | |
| 12/18-5-13 | Bath 1 SB | N201A-16% | 2200 | 4.5 | Exh | 180 | 20 | 5.41 | 2.99 | 8.88 | 47.28 |
| | Bath 2 Pol | none | | | | | | | | | |
| | Topical FC | TG3361-0.5% | 40 | | Dry | 230 | 5 | | | | |
| 12/18-5-14 | Bath 1 SB | LFS30-16%, CLM-1% | 2200 | 2.2 | Exh | 180 | 20 | 0.77 | 4.71 | 17.5 | 58.82 |
| | Bath 2 Pol | none | | | | | | | | | |
| | Topical FC | TG3361-0.5% | 40 | | Dry | 230 | 5 | | | | |
| 12/18-5-15 | Bath 1 SB | FX661-16% | 2200 | 2.2 | Exh | 180 | 20 | 4.46 | 3.32 | 25.94 | 61.56 |
| | Bath 2 Pol | none | | | | | | | | | |
| | Topical FC | TG3361-0.5% | 40 | | Dry | 230 | 5 | | | | |
| 12/18-5-16 | Bath 1 SB | RM-16% | 2200 | 2.2 | Exh | 180 | 20 | 1.22 | 3.01 | 26.1 | 53.77 |
| | Bath 2 Pol | none | | | | | | | | | |
| | Topical FC | TG3361-0.5% | 40 | | Dry | 230 | 5 | | | | |

TABLE 5C-continued

2099 Type 6, 6 Superba set cut-pile construction

| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| 12/18-5-17 | Bath 1 SB | N201A-16% | 400 | 4.5 | Cont | 210 | 5 | 4.83 | 2.79 | 9.87 | 24.15 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-18 | Bath 1 SB | LFS30-16%, CLM-1% | 400 | 1.6 | Cont | 210 | 5 | 1.1 | 2.57 | 12.2 | 38.44 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-19 | Bath 1 SB | FX661-16% | 400 | 1.6 | Cont | 210 | 5 | 3.74 | 0.75 | 8.88 | 48.71 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-20 | Bath 1 SB | RM-16% | 400 | 1.6 | Cont | 210 | 5 | 1.26 | 1.43 | 5.78 | 31.09 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-21 | Bath 1 SB | N201A-16% | 2200 | 4.5 | Exh | 180 | 20 | 3.25 | 2.55 | 7.52 | 29.02 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-22 | Bath 1 SB | LFS30-16%, CLM-1% | 2200 | 2.2 | Exh | 180 | 20 | 1.44 | 4.58 | 10.19 | 41.3 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-23 | Bath 1 SB | FX661-16% | 2200 | 2.2 | Exh | 180 | 20 | 3.94 | 1.62 | 7.66 | 44.47 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-24 | Bath 1 SB | RM-16% | 2200 | 2.2 | Exh | 180 | 20 | 1.23 | 1.62 | 9.79 | 36.22 |
| | Bath 2 Pol | 52DM-12% | 400 | 1.55 | Cont | 210 | 2 | | | | |
| | Topical FC | TG3361-0.5% | 40 | | Dry | 230 | 5 | | | | |
| 12/18-5-25 | Bath 1 SB | N201A-16% | 400 | 4.5 | Cont | 210 | 5 | 7.79 | 4.28 | 15 | 37.34 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-26 | Bath 1 SB | LFS30-16%, CLM-1% | 400 | 1.6 | Cont | 210 | 5 | 2.25 | 7.76 | 29.79 | 52.64 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-27 | Bath 1 SB | FX661-16% | 400 | 1.6 | Cont | 210 | 5 | 2.69 | 3.77 | 48.54 | 64.25 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-28 | Bath 1 SB | RM-16% | 400 | 1.6 | Cont | 210 | 5 | 0.99 | 3.17 | 22.02 | 63.49 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-29 | Bath 1 SB | N201A-16% | 2200 | 4.5 | Exh | 180 | 20 | 4.87 | 6.09 | 14.52 | 64.09 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-30 | Bath 1 SB | LFS30-16%, CLM-1% | 2200 | 2.2 | Exh | 180 | 20 | 2.63 | 7.4 | 42.72 | 64.1 |
| | Bath 2 Pol | ECO-12% | 400 | 4 | Cont | 210 | 2 | | | | |
| | Topical FC | TG3361-0.5% | 40 | | Dry | 230 | 5 | | | | |

TABLE 5C-continued

| 2099 Type 6, 6 Superba set cut-pile construction | | | | | | | | | | | |
|---|---|---|---|---|---|---|---|---|---|---|---|
| Sample | Treatment Scheme | Treatment Type | % wpu | Bath pH | Heating Type | Temp F. | Dwell min | Xenon 40 hr DE CMC | Red Wine 24 hr DE CMC | Mustard 24 hr DE CMC | Betadine 24 hr DE CMC |
| 12/18-5-31 | Bath 1 SB | FX661-16% | 2200 | 2.2 | Exh | 180 | 20 | 3.14 | 4.78 | 39.13 | 64.52 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-32 | Bath 1 SB | RM-16% | 2200 | 2.2 | Exh | 180 | 20 | 1.55 | 5.2 | 42.71 | 66.63 |
| | Bath 2 Pol | ECO-12% | 400 | 4 | Cont | 210 | 2 | | | | |
| | Topical FC | TG3361-0.5% | 40 | | Dry | 230 | 5 | | | | |
| 12/18-5-33 | Bath 1 SB | none | | | | | | 3.71 | 8.43 | 53.3 | 66.89 |
| | Bath 2 Pol | none | | | | | | | | | |
| | Topical FC | none | | | | | | | | | |

As can be seen from the above data, 2099, which is a cut-pile, light colored greige nylon 6,6 sample generally requires a three step treatment to give a commercially relevant improvement in staining. However for all treatments conforming to the invention, improvement in stain resistance is seen over the one step treatments, including those SAC treatments of Pacifici. Further, the One Step SAC treatment of Pacifici (ex. 12/18-5-1 and 12/8-5-5) provides some improvement in stain resistance over untreated, each of these treatments gives a high value for yellowing. Such yellowing values 9.82 Delta E CMC units (12/18-5-1 and 12/8-5-5) result in noticeable yellowing of the 2099 cut-pile carpet and are unacceptable for use in a commercial product.

Figure 9:
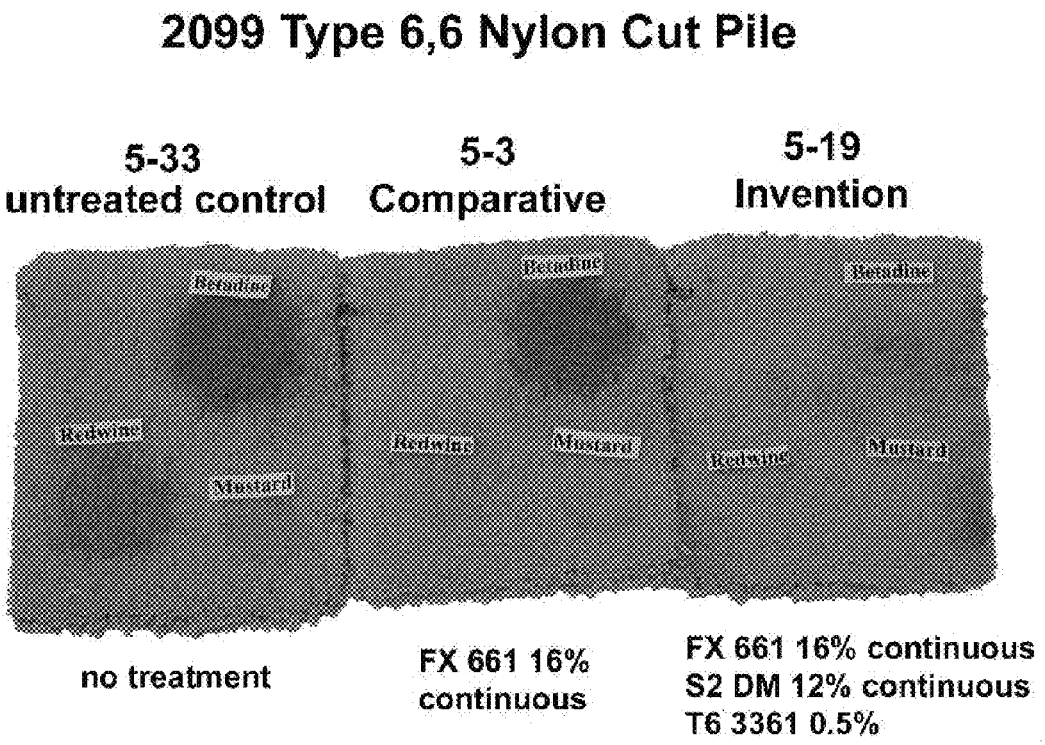
FIG. 9 is a color photograph of Betadine, mustard and red wine staining on 2099 Type 6,6 cut-pile nylon carpet samples. The stainblocker tested is FX 661.
Figure 10:
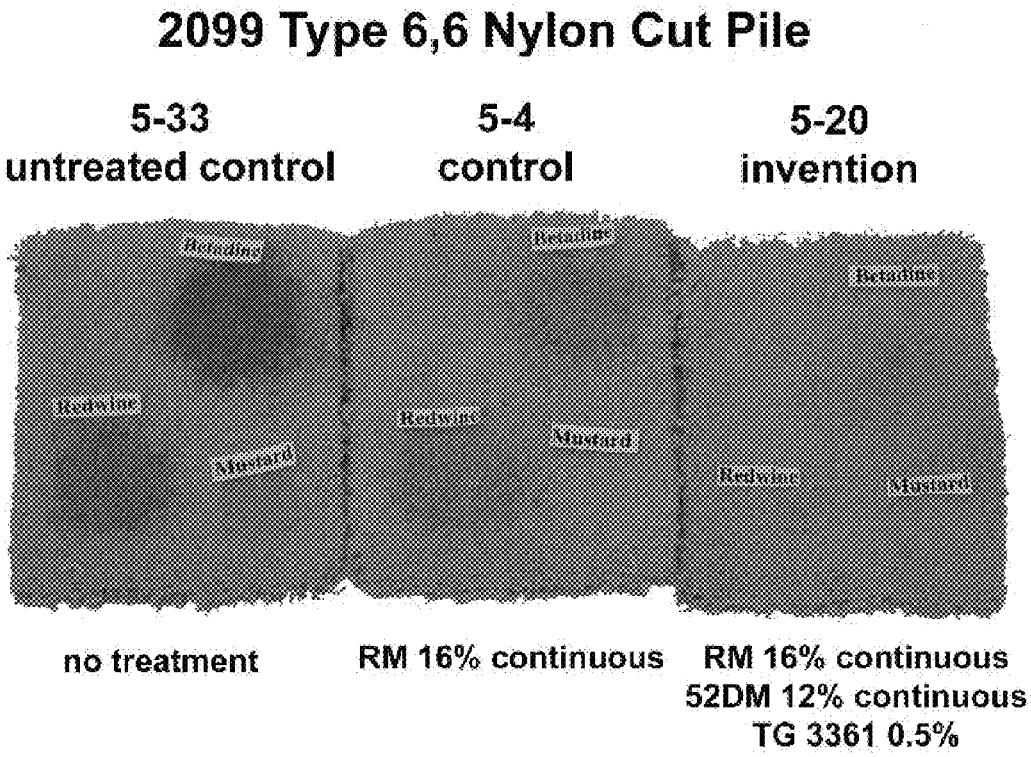
FIG. 10 is a color photograph of Betadine, mustard and red wine staining on 2099 Type 6,6 cut-pile nylon carpet samples. The stainblocker tested is RM.
Figure 11:
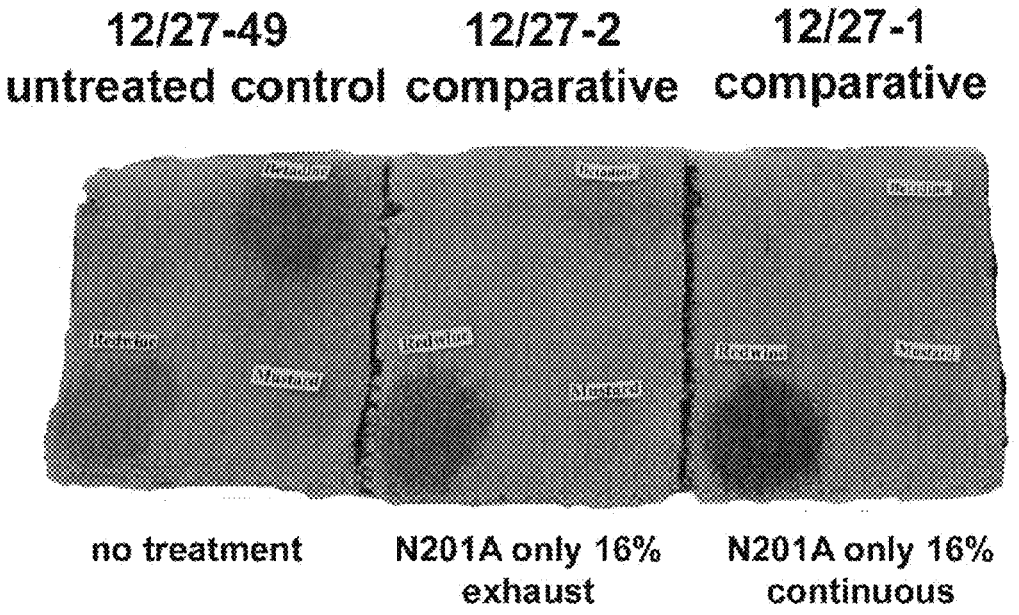
FIG. 11 is a color photograph of Betadine, mustard and red wine staining on 1339 Type 6 cut-pile nylon carpet samples. The stainblocker tested is N 201A.
Figure 11:
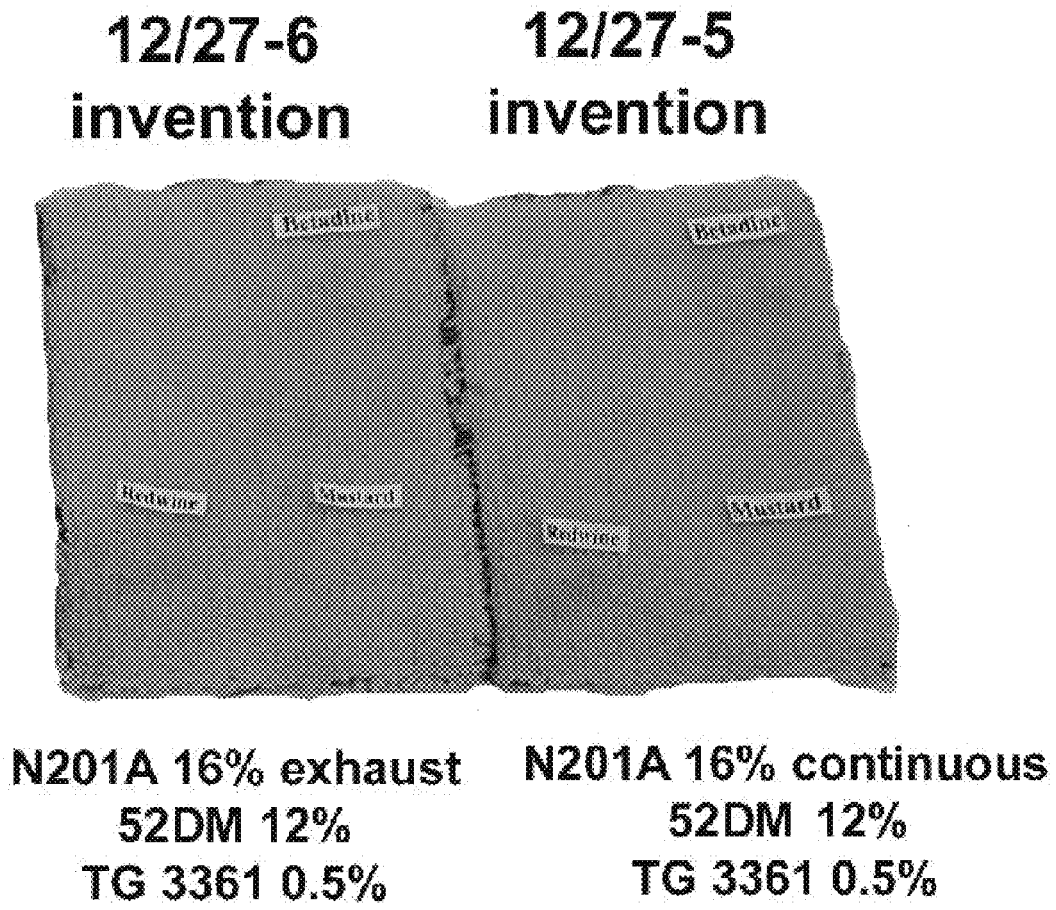

Visual representations of a selection of this data is presented in FIGS. 9-11.

Also, while the staining for 2099 is more severe than with the loop pile greige good samples (Scholar and Academy) this is not unexpected because a cut-pile carpet will necessarily absorb stain within the fiber cross-section. Notwithstanding this greater staining with 2099, improvements are seen with the present invention in stain ratings. In particular, the methods of the present invention provide acceptable stain resistance of cut-pile nylon carpet.

Photographs of 2099 cut pile samples treated with the present invention are provided in FIGS. 9-11.

A summary of the data in Tables 5A-5D is provided in FIG. 14.

TABLE 5D

| 1339 Type 6 Superba set staple in a cut-pile construction | | | | | | | | | | | |
|---|---|---|---|---|---|---|---|---|---|---|---|
| Sample | Treatment Scheme | Treatment Type | % wpu | Bath pH | Heating Type | Temp Deg F. | Dwell Min | Xenon 40 hr DE CMC | Red Wine 24 hr DE CMC | Mustard 24 hr DE CMC | Betadine 24 hr DE CMC |
| 12/27-1 | Bath 1 SB | N201A-16% | 400 | 4.5 | Cont | 210 | 5 | 8.78 | 23.31 | 38.19 | 61.73 |
| | Bath 2 Pol | none | | | | | | | | | |
| | Topical FC | none | | | | | | | | | |
| 12/27-2 | Bath 1 SB | N201A-16% | 2200 | 2.2 | Exh | 180 | 20 | 16.29 | 23.79 | 28.36 | 25.39 |
| | Bath 2 Pol | none | | | | | | | | | |
| | Topical FC | none | | | | | | | | | |
| 12/27-3 | Bath 1 SB | N201A-16% | 400 | 4.5 | Cont | 210 | 5 | 9.45 | 8.68 | 21.08 | 48.67 |
| | Bath 2 Pol | none | | | | | | | | | |
| | Topical FC | TG3361-.5% | 40 | | Dry | 230 | 5 | | | | |
| 12/27-4 | Bath 1 SB | N201A-16% | 2200 | 2.2 | Exh | 180 | 20 | 17.32 | 7.06 | 11.32 | 19.72 |
| | Bath 2 Pol | none | | | | | | | | | |
| | Topical FC | TG3361-.5% | 40 | | Dry | 230 | 5 | | | | |
| 12/27-5 | Bath 1 SB | N201A-16% | 400 | 4.5 | Cont | 210 | 5 | 10.34 | 7.24 | 9.38 | 26.46 |
| | Bath 2 Pol | 52DM-12% | 400 | 1.55 | Cont | 210 | 2 | | | | |
| | Topical FC | TG3361-.5% | 40 | | Dry | 230 | 5 | | | | |

TABLE 5D-continued

1339 Type 6 Superba set staple in a cut-pile construction

| Sample | Treatment Scheme | Treatment Type | % wpu | Bath pH | Heating Type | Temp Deg F. | Dwell Min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| 12/27-6 | Bath 1 SB | N201A-16% | 2200 | 2.2 | Exh | 180 | 20 | 13.87 | 2.79 | 13.81 | 24 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-7 | Bath 1 SB | N201A-16% | 400 | 4.5 | Cont | 210 | 5 | 13.38 | 6.34 | 19.36 | 46.41 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-8 | Bath 1 SB | N201A-16% | 2200 | 2.2 | Exh | 180 | 20 | 15.78 | 5.5 | 4.3 | 41.38 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-9 | Bath 1 SB | LFS30F-15%, CLM-1% | 400 | 4.5 | Cont | 210 | 5 | 7.02 | 9.8 | 25.2 | 50.57 |
| | Bath 2 Pol | none | | | | | | | | | |
| | Topical FC | none | | | | | | | | | |
| 12/27-10 | Bath 1 SB | LFS30F-15%, CLM-1% | 2200 | 2.2 | Exh | 180 | 20 | 6.55 | 5.7 | 19.79 | 66.37 |
| | Bath 2 Pol | none | | | | | | | | | |
| | Topical FC | none | | | | | | | | | |
| 12/27-11 | Bath 1 SB | LFS30F-15%, CLM-1% | 400 | 4.5 | Cont | 210 | 5 | 7.65 | 6.39 | 8.41 | 33.45 |
| | Bath 2 Pol | none | | | | | | | | | |
| | Topical FC | TG3361-.5% | 40 | | Dry | 230 | 5 | | | | |
| 12/27-12 | Bath 1 SB | LFS30F-15%, CLM-1% | 2200 | 2.2 | Exh | 180 | 20 | 7.13 | 6.22 | 8.93 | 49.72 |
| | Bath 2 Pol | none | | | | | | | | | |
| | Topical FC | TG3361-.5% | 40 | | Dry | 230 | 5 | | | | |
| 12/27-13 | Bath 1 SB | LFS30F-15%, CLM-1% | 400 | 4.5 | Cont | 210 | 5 | 6.18 | 4.05 | 6.43 | 19.75 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-14 | Bath 1 SB | LFS30F-15%, CLM-1% | 2200 | 2.2 | Exh | 180 | 20 | 5.82 | 4.66 | 12.13 | 46.35 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-15 | Bath 1 SB | LFS30F-15%, CLM-1% | 400 | 4.5 | Cont | 210 | 5 | 9.7 | 7.38 | 26.05 | 62.59 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-16 | Bath 1 SB | LFS30F-15%, CLM-1% | 2200 | 2.2 | Exh | 180 | 20 | 9.11 | 6.03 | 34.29 | 59.68 |
| | Bath 2 Pol | ECO-12% | 400 | 4 | Cont | 210 | 2 | | | | |
| | Topical FC | TG3361-.5% | 40 | | Dry | 230 | 5 | | | | |

TABLE 5D-continued

1339 Type 6 Superba set staple in a cut-pile construction

| Sample | Treatment Scheme | Treatment Type | % wpu | Bath pH | Heating Type | Temp Deg F. | Dwell Min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| 12/27-17 | Bath 1 SB | FX661-16% | 400 | 4.5 | Cont | 210 | 5 | 3.01 | 15.48 | 37.34 | 66.31 |
| | Bath 2 Pol | none | | | | | | | | | |
| | Topical FC | none | | | | | | | | | |
| 12/27-18 | Bath 1 SB | FX661-16% | 2200 | 2.2 | Exh | 180 | 20 | 1.95 | 5.91 | 29.91 | 73.15 |
| | Bath 2 Pol | none | | | | | | | | | |
| | Topical FC | none | | | | | | | | | |
| 12/27-19 | Bath 1 SB | FX661-16% | 400 | 4.5 | Cont | 210 | 5 | 4.03 | 6.44 | 24.84 | 33.33 |
| | Bath 2 Pol | none | | | | | | | | | |
| | Topical FC | TG3361-.5% | 40 | | Dry | 230 | 5 | | | | |
| 12/27-20 | Bath 1 SB | FX661-16% | 2200 | 2.2 | Exh | 180 | 20 | 1.92 | 4.33 | 32.97 | 52.11 |
| | Bath 2 Pol | none | | | | | | | | | |
| | Topical FC | TG3361-.5% | 40 | | Dry | 230 | 5 | | | | |
| 12/27-21 | Bath 1 SB | FX661-16% | 400 | 4.5 | Cont | 210 | 5 | 3.85 | 2.74 | 14.89 | 44.7 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-22 | Bath 1 SB | FX661-16% | 2200 | 2.2 | Exh | 180 | 20 | 2.08 | 1.72 | 7.75 | 49.8 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-23 | Bath 1 SB | FX661-16% | 400 | 4.5 | Cont | 210 | 5 | 5.74 | 5.41 | 17.24 | 59.47 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-24 | Bath 1 SB | FX661-16% | 2200 | 2.2 | Exh | 180 | 20 | 2.95 | 4.83 | 22.79 | 67.6 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-25 | Bath 1 SB | RM-16% | 400 | 4.5 | Cont | 210 | 5 | 7.55 | 33.22 | 40.67 | 55.22 |
| | Bath 2 Pol | none | | | | | | | | | |
| | Topical FC | none | | | | | | | | | |
| 12/27-26 | Bath 1 SB | RM-16% | 2200 | 2.2 | Exh | 180 | 20 | 8.87 | 36.8 | 39.07 | 45.91 |
| | Bath 2 Pol | none | | | | | | | | | |
| | Topical FC | none | | | | | | | | | |
| 12/27-27 | Bath 1 SB | RM-16% | 400 | 4.5 | Cont | 210 | 5 | 8.36 | 12.23 | 12.32 | 50.09 |
| | Bath 2 Pol | none | | | | | | | | | |
| | Topical FC | TG3361-.5% | 40 | | Dry | 230 | 5 | | | | |
| 12/27-28 | Bath 1 SB | RM-16% | 2200 | 2.2 | Exh | 180 | 20 | 8.9 | 11.84 | 11.07 | 44.62 |
| | Bath 2 Pol | none | | | | | | | | | |
| | Topical FC | TG3361-.5% | 40 | | Dry | 230 | 5 | | | | |

TABLE 5D-continued

1339 Type 6 Superba set staple in a cut-pile construction

| Sample | Treatment Scheme | Treatment Type | % wpu | Bath pH | Heating Type | Temp Deg F. | Dwell Min | Xenon 40 hr DE CMC | Red Wine 24 hr DE CMC | Mustard 24 hr DE CMC | Betadine 24 hr DE CMC |
|---|---|---|---|---|---|---|---|---|---|---|---|
| 12/27-29 | Bath 1 SB | RM-16% | 400 | 4.5 | Cont | 210 | 5 | 8.89 | 5.31 | 8.78 | 20.43 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-30 | Bath 1 SB | RM-16% | 2200 | 2.2 | Exh | 180 | 20 | 8.65 | 3.9 | 5.7 | 15.03 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-31 | Bath 1 SB | RM-16% | 400 | 4.5 | Cont | 210 | 5 | 11.1 | 2.36 | 9.38 | 38.2 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-32 | Bath 1 SB | RM-16% | 2200 | 2.2 | Exh | 180 | 20 | 11.8 | 3.08 | 4.45 | 33.78 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-33 | Bath 1 SB | SR 525-16% | 400 | 4.5 | Cont | 210 | 5 | 6.28 | 13.77 | 41.63 | 72.38 |
| | Bath 2 Pol | none | | | | | | | | | |
| | Topical FC | none | | | | | | | | | |
| 12/27-34 | Bath 1 SB | SR 525-16% | 2200 | 2.2 | Exh | 180 | 20 | 5.37 | 3.48 | 13.76 | 72.19 |
| | Bath 2 Pol | none | | | | | | | | | |
| | Topical FC | none | | | | | | | | | |
| 12/27-35 | Bath 1 SB | SR 525-16% | 400 | 4.5 | Cont | 210 | 5 | 6.78 | 4.94 | 18.94 | 60.76 |
| | Bath 2 Pol | none | | | | | | | | | |
| | Topical FC | TG3361-.5% | 40 | | Dry | 230 | 5 | | | | |
| 12/27-36 | Bath 1 SB | SR 525-16% | 2200 | 2.2 | Exh | 180 | 20 | 5.1 | 6.85 | 19.58 | 73.55 |
| | Bath 2 Pol | none | | | | | | | | | |
| | Topical FC | TG3361-.5% | 40 | | Dry | 230 | 5 | | | | |
| 12/27-37 | Bath 1 SB | SR 525-16% | 400 | 4.5 | Cont | 210 | 5 | 6.66 | 2.63 | 25.15 | 58.2 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-38 | Bath 1 SB | SR 525-16% | 2200 | 2.2 | Exh | 180 | 20 | 3.85 | 1.42 | 20.6 | 65.42 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-39 | Bath 1 SB | SR 525-16% | 400 | 4.5 | Cont | 210 | 5 | 7.55 | 6.94 | 32.55 | 61.84 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-40 | Bath 1 SB | SR 525-16% | 2200 | 2.2 | Exh | 180 | 20 | 6.3 | 5.68 | 51.87 | 65.14 |
| | Bath 2 Pol | ECO-12% | 400 | 4 | Cont | 210 | 2 | | | | |
| | Topical FC | TG3361-.5% | 40 | | Dry | 230 | 5 | | | | |

TABLE 5D-continued

| 1339 Type 6 Superba set staple in a cut-pile construction | | | | | | | | | | | |
|---|---|---|---|---|---|---|---|---|---|---|---|
| Sample | Treatment Scheme | Treatment Type | % wpu | Bath pH | Heating Type | Temp Deg F. | Dwell Min | Xenon 40 hr DE CMC | Red Wine 24 hr DE CMC | Mustard 24 hr DE CMC | Betadine 24 hr DE CMC |
| 12/27-41 | Bath 1 SB | CLM-1% | 400 | 4.5 | Cont | 210 | 5 | 5.67 | 15.26 | 60.16 | 75.75 |
| | Bath 2 Pol | none | | | | | | | | | |
| | Topical FC | none | | | | | | | | | |
| 12/27-42 | Bath 1 SB | CLM-1% | 2200 | 2.2 | Exh | 180 | 20 | 6.6 | 8.96 | 56.1 | 75.37 |
| | Bath 2 Pol | none | | | | | | | | | |
| | Topical FC | none | | | | | | | | | |
| 12/27-43 | Bath 1 SB | CLM-1% | 400 | 4.5 | Cont | 210 | 5 | 7.37 | 5.31 | 55.55 | 71.14 |
| | Bath 2 Pol | none | | | | | | | | | |
| | Topical FC | TG3361-.5% | 40 | | Dry | 230 | 5 | | | | |
| 12/27-44 | Bath 1 SB | CLM-1% | 2200 | 2.2 | Exh | 180 | 20 | 7.7 | 4.8 | 33.81 | 67.6 |
| | Bath 2 Pol | none | | | | | | | | | |
| | Topical FC | TG3361-.5% | 40 | | Dry | 230 | 5 | | | | |
| 12/27-45 | Bath 1 SB | CLM-1% | 400 | 4.5 | Cont | 210 | 5 | 5.33 | 2.04 | 10.09 | 56.87 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-46 | Bath 1 SB | CLM-1% | 2200 | 2.2 | Exh | 180 | 20 | 6.01 | 3.1 | 7.05 | 48.78 |
| | Bath 2 Pol | 52DM-12% | 400 | 1.55 | Cont | 210 | 2 | | | | |
| | Topical FC | TG3361-.5% | 40 | | Dry | 230 | 5 | | | | |
| 12/27-47 | Bath 1 SB | CLM-1% | 400 | 4.5 | Cont | 210 | 5 | 6.18 | 5.13 | 21.9 | 73.23 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-48 | Bath 1 SB | CLM-1% | 2200 | 2.2 | Exh | 180 | 20 | 7.28 | 6.06 | 37.53 | 73.66 |
| | Bath 2 Pol | ECO-12% | 400 | 4 | Cont | 210 | 2 | | | | |
| | Topical FC | TG3361-.5% | 40 | | Dry | 230 | 5 | | | | |
| 12/27-49 | Bath 1 SB | none | | | | | | 1.58 | 7.62 | 60.71 | 77.56 |
| | Bath 2 Pol | none | | | | | | | | | |
| | Topical FC | none | | | | | | | | | |

The above table demonstrates that the present invention provides excellent stain resistance on nylon 6 cut pile carpet samples. In particular, the stain resistance improvement over the methods of the '758 patent are notable.

Figure 12:
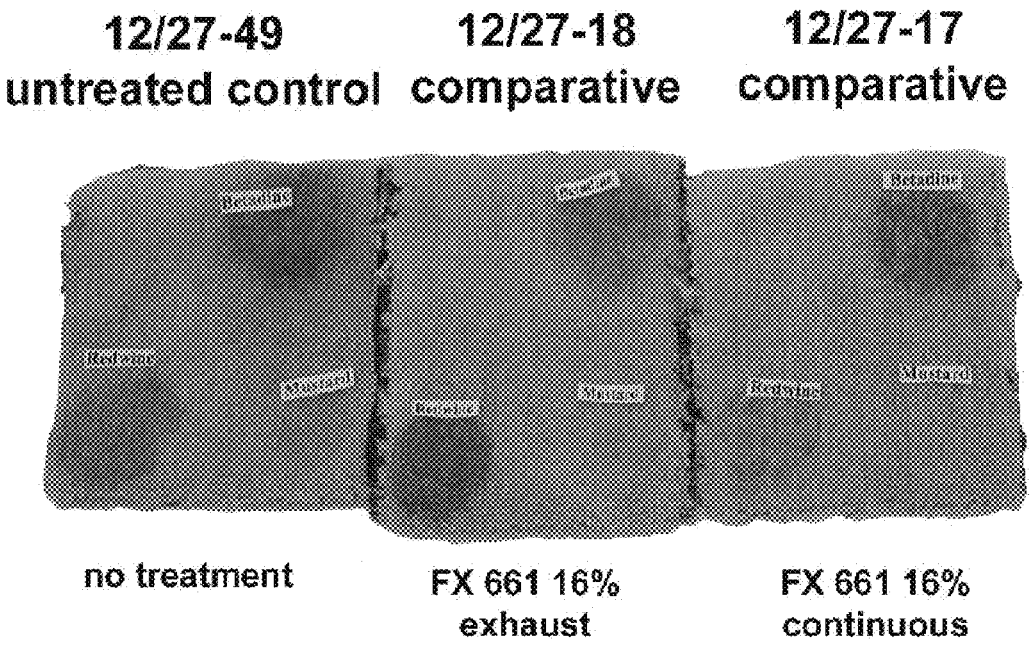
FIG. 12 is a color photograph of Betadine, mustard and red wine on 1339 Type 6 cut-pile nylon carpet samples. The stainblocker tested is FX 661.
Figure 12:
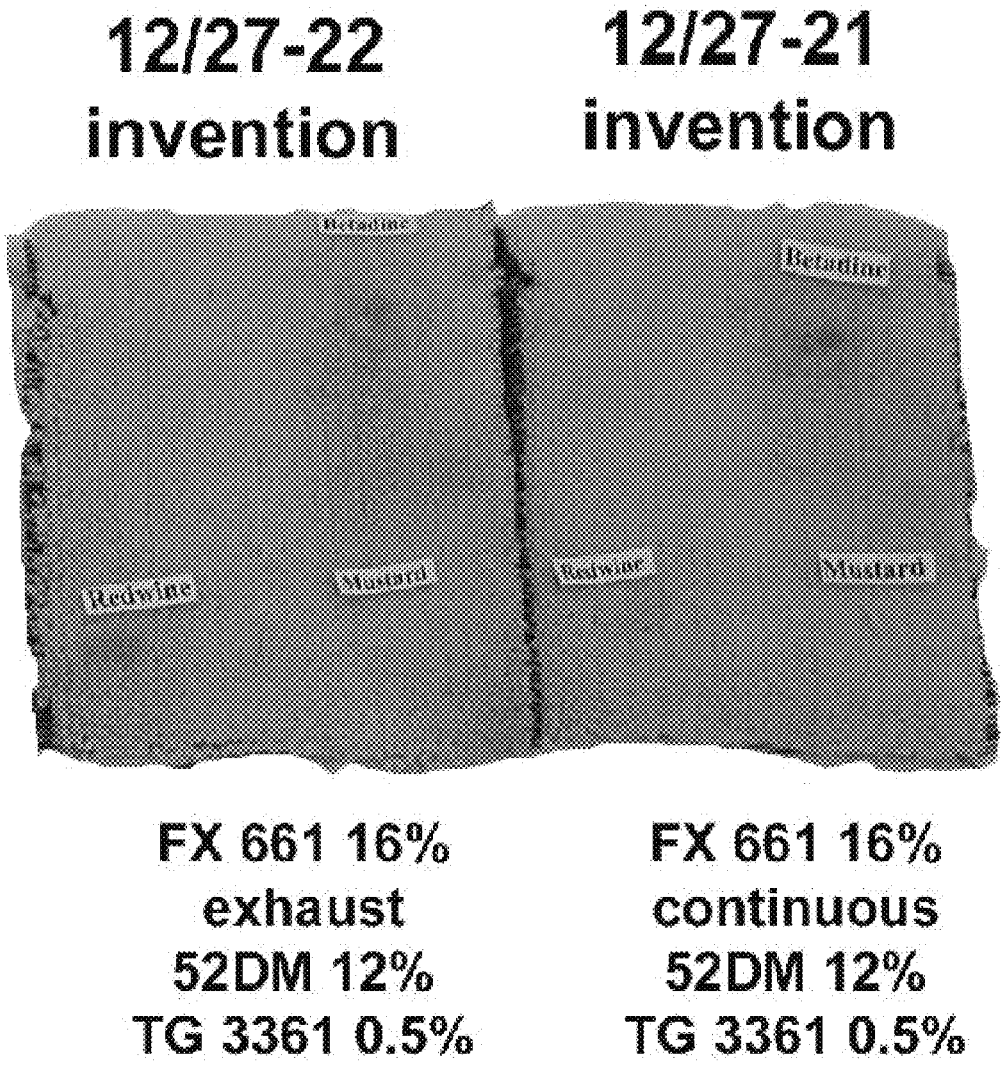
Figure 13:
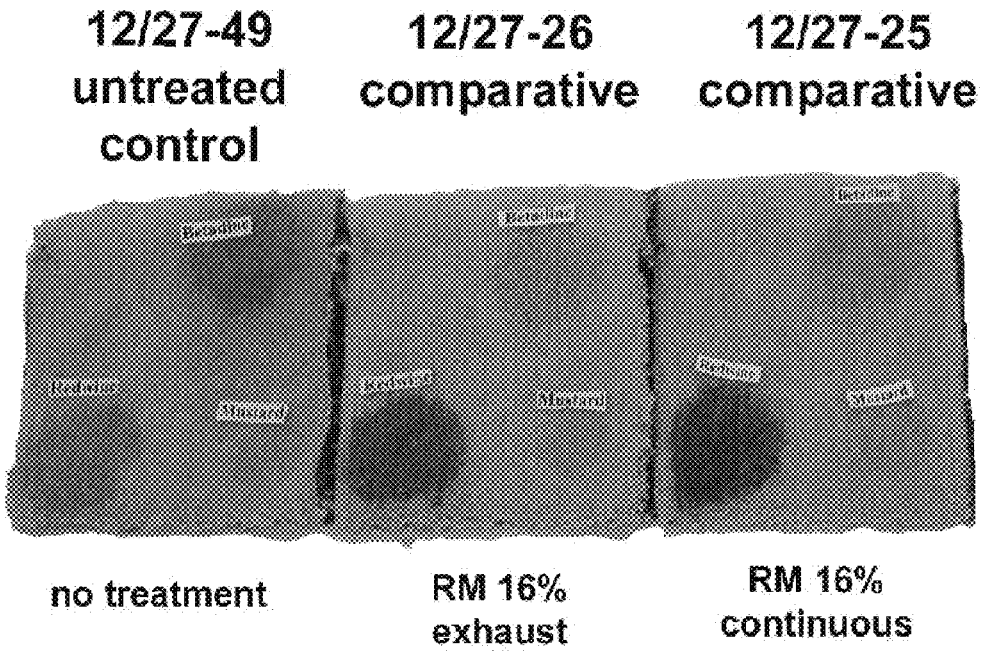
FIG. 13 is a color photograph of Betadine, mustard and red wine on 1339 Type 6 cut-pile nylon carpet samples. The stainblocker tested is RM.
Figure 13:
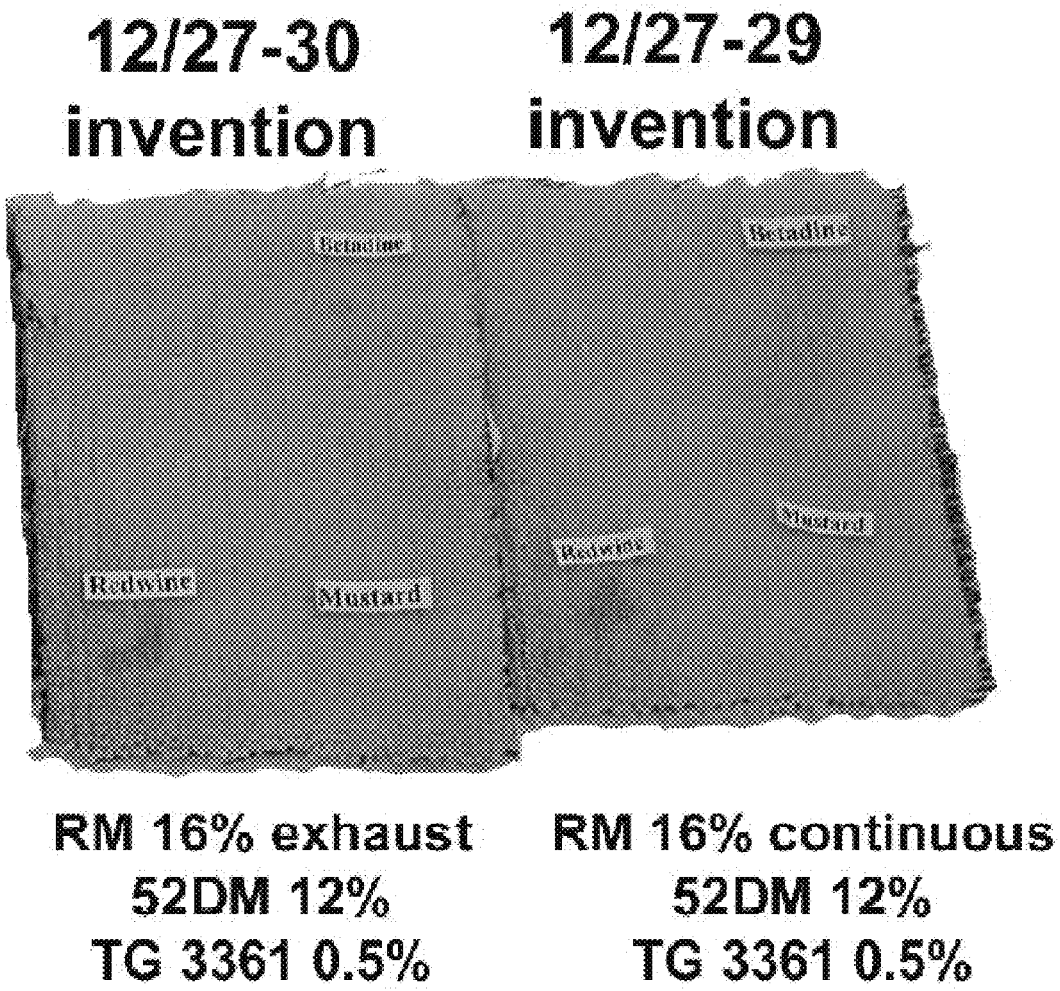

FIGS. 11-13 provide photographs of some 1339 carpet samples treated with the invention.

A summary of the data in Tables 5A-5D is provided in FIG. 14.

It will be apparent to those skilled in the art that various modifications and variations can be made in the present invention without departing from the scope of the invention. Other aspects of the invention will be apparent to those skilled in the art from consideration of the specification and practice of the invention disclosed herein. It is intended that the specification and examples be considered as exemplary only.

What is claimed is:

1. A method of making a nylon material resistant to staining by neutral colorants comprising:

a) applying a stainblocker composition to a nylon material, wherein the stainblocker comprises a high molecular weight, low OH-containing phenyl/phenol acrylic acid polymer and is present at from about 1.0% to about 10% owf by weight solids on fiber;

b) applying an exhaustible polymer composition at a concentration of from about 1.0% to about 10.0% owf by weight solids on fiber to the nylon material after application of step a), wherein the exhaustible polymer composition comprises a multipolymer of styrene, acrylic acid and methacrylic acid, anionic character; and c) applying a topical treatment composition to the nylon material after application of step b), wherein the topical treatment comprises a fluoropolymer comprising one or more polyvinylchloride segments applied in a dry fix application at 0.001% to about 1.0% owf by weight solids on fiber, thereby providing the nylon material with a greater resistance to staining by neutral colorants as measured by Delta E CMC value, when stained with a 10% povidone-iodine solution, of at least about 40% less than the Delta E CMC value of a second nylon material stained with the solution and treated with step a) alone.

2. The method of claim 1, wherein the resistance to staining by neutral colorants is measured by Delta E CMC value and wherein the Delta E CMC value for the nylon material treated with steps a), b), and c) and stained with a 10% povidone-iodine solution is less than about 6.

3. The method of claim 1, wherein the stainblocker composition further comprises tannic acid.

4. The method of claim 3, wherein the tannic acid has a gallic acid content of less than about 3.0 parts by weight (pbw).

5. The method of claim 1, wherein either or both of the treatments of step a) and step b) is applied from an exhaust bath application, and wherein liquor to goods range is from about 8:1 to about 80:1.

6. The method of claim 1, wherein either or both of the treatments of step a) and step b) is applied from a continuous application bath, and wherein the liquor to goods range is from about 1:1 to about 8:1.

7. The method of claim 1, wherein step c) is applied using a either a foam or a spray application.

8. The method of claim 1, wherein the nylon material comprises type 6 or type 6,6 fibers.

9. The method of claim 1, wherein the nylon material comprises a fiber.

10. The method of claim 1, wherein the stainblocker composition further comprises at least one colorant.

11. The method of claim 10, wherein the at least one colorant comprises an acid dye colorant.

12. The method of claim 1, wherein the stainblocker composition further comprises a sulfonated aromatic condensate polymer and, optionally, one or more antioxidants.

13. The method of claim 1, wherein the fluorochemical comprises a non-ionic to slightly cationic perfluoroester-derived fluoropolymer.

14. A method of making a nylon material resistant to staining by neutral colorants comprising:

a) applying to a nylon material a composition comprising:

i) at least one stainblocker, wherein the stainblocker comprises a high molecular weight, low OH-containing phenyl/phenol acrylic acid polymer and is present at from about 1.0% to about 10% owf by weight solids on fiber, and ii) tannic acid;

b) applying an exhaustible polymer composition at a concentration of from about 1.0% to about 10.0% owf by weight solids on fiber to the nylon material after application of step a), wherein the exhaustible polymer composition comprises a multipolymer of styrene, acrylic acid and methacrylic acid, anionic character, in a separate bath, in separate application and fixation steps; and c) applying a topical treatment composition to the nylon material after application and fixation of step b), wherein the topical treatment comprises a fluoropolymer comprising one or more polyvinylchloride segments applied in a dry fix application at 0.001% to about 1.0% owf by weight solids on fiber, thereby providing a nylon material with a greater resistance to staining by neutral colorants than a nylon material treated with step a) alone.

15. The method of claim 14, wherein the stainblocker composition further comprises a sulfonated aromatic condensate polymer and, optionally, one or more antioxidants.

16. The method of claim 14, wherein the fluoropolymer comprises a non-ionic to slightly cationic perfluoroester-derived fluoropolymer.

17. The method of claim 14, wherein the stainblocker composition further comprises at least one colorant.

18. The method of claim 17, wherein the at least one colorant comprises an acid dye colorant.

19. A method of making a nylon material resistant to staining by neutral colorants comprising:

a) applying a stainblocker composition to a nylon material, wherein the stainblocker comprises a high molecular weight, low OH-containing phenyl/phenol acrylic acid polymer and is present at from about 1.0% to about 10% owf by weight solids on fiber;

b) applying an exhaustible polymer composition at a concentration of from about 1.0% to about 10.0% owf by weight solids on fiber to the nylon material after application of step a), wherein the exhaustible polymer composition comprises a multipolymer of styrene, acrylic acid and methacrylic acid, anionic character; and c) applying a topical treatment composition to the nylon material after application of step b), wherein the topical treatment comprises a fluoropolymer comprising one or more polyvinylchloride segments applied in a dry fix application at 0.001% to about 1.0% owf by weight solids on fiber, wherein the fluorochemical comprises a non-ionic to slightly cationic perfluoroester-derived fluoropolymer or one or more polyvinylchloride segments, thereby providing the nylon material with a greater resistance to staining by neutral colorants as measured by Delta E CMC value, when stained with a 10% povidone-iodine solution, of at least about 40% less than the Delta E CMC value of a second nylon material stained with the solution and treated with step a) alone.

20. The method of claim 19, wherein the resistance to staining by neutral colorants is measured by Delta E CMC value and wherein the Delta E CMC value for the nylon material treated with steps a), b), and c) and stained with a 10% povidone-iodine solution is less than about 6.

21. The method of claim 19, wherein the stainblocker composition further comprises tannic acid.

22. The method of claim 21, wherein the tannic acid has a gallic acid content of less than about 3.0 parts by weight (pbw).

23. The method of claim 19, wherein the stainblocker composition further comprises a sulfonated aromatic condensate polymer and, optionally, one or more antioxidants.

* * * * *